US011135459B1

(12) United States Patent
Caldwell

(10) Patent No.: US 11,135,459 B1
(45) Date of Patent: Oct. 5, 2021

(54) DUAL FILTRATION COVID-19 MASK

(71) Applicant: Robert Caldwell, Bethel, CA (US)

(72) Inventor: Robert Caldwell, Bethel, CA (US)

( * ) Notice: Subject to any disclaimer, the term of this patent is extended or adjusted under 35 U.S.C. 154(b) by 0 days.

(21) Appl. No.: 17/308,982

(22) Filed: May 5, 2021

Related U.S. Application Data

(63) Continuation of application No. 17/236,583, filed on Apr. 21, 2021, now abandoned.

(51) Int. Cl.
*A62B 23/02* (2006.01)
*A62B 18/10* (2006.01)

(52) U.S. Cl.
CPC ..... *A62B 23/02* (2013.01); *A62B 18/10* (2013.01)

(58) Field of Classification Search
CPC ..... A62B 23/02; A62B 18/10
See application file for complete search history.

(56) References Cited

U.S. PATENT DOCUMENTS 403,966 A * 5/1889 Smith ..... A62B 18/10 128/206.15
1,229,050 A * 6/1917 Donald ..... A62B 23/02 128/205.27
2,344,920 A * 3/1944 Maggi ..... A62B 18/00 128/201.19
2,741,246 A * 4/1956 Litchfield ..... A62B 18/02 128/201.13
4,458,679 A * 7/1984 Ward ..... A61M 16/06 128/201.13
4,610,247 A * 9/1986 Stroup ..... A42B 1/046 128/201.22
4,809,692 A * 3/1989 Nowacki ..... A61M 15/0086 128/203.29
6,834,649 B1 12/2004 Kuo
8,490,623 B2 * 7/2013 Berthon-Jones ..... A61M 16/0605 128/206.21
8,769,728 B2 7/2014 Shiue
8,869,798 B2 * 10/2014 Wells ..... A61M 16/0622 128/206.24
10,322,312 B1 * 6/2019 Danford ..... A62B 18/10
10,757,988 B1 9/2020 Swogger
11,013,277 B1 * 5/2021 Alhumood ..... A41D 13/1161
(Continued)

OTHER PUBLICATIONS

"What Masks are Effective for Coronavirus & Can They be Reused?," OURA (Mar. 31, 2020).

(Continued)

*Primary Examiner* — Kathryn E Ditmer
(74) *Attorney, Agent, or Firm* — J. Steven Svoboda

(57) ABSTRACT

A mask includes: an intake valve panel comprising one or more intake valves, the intake valve panel further comprising an intake filter configured to filter the user's intake breath, the intake valve panel positioned in a center of the mask; one or more exhaust tubes, at least one of the one or more exhaust tubes comprising at least one of the exhaust valves, at least one of the exhaust tubes configured to conduct the user's exhale breath through the at least one of the exhaust valves and then out of the mask, at least one exhaust tube holding the at least one exhaust valve tightly while allowing the at least one exhaust valve to open and close freely; and a soft foam lining configured to tightly hold the mask against the user's face.

18 Claims, 16 Drawing Sheets

(56) References Cited

U.S. PATENT DOCUMENTS

| | | | | |
|---|---|---|---|---|
| 2008/0223370 | A1* | 9/2008 | Kim | A62B 23/02 128/206.17 |
| 2012/0047638 | A1 | 3/2012 | Shiue | |
| 2019/0232013 | A1* | 8/2019 | Yu | G06T 19/20 |
| 2020/0289989 | A1 | 9/2020 | Wahi | |

OTHER PUBLICATIONS

"3M 50051138543681 Particulate Filter 2076, P95 (Pack of 2)." by 3M, Amazon.com (Dec. 6, 2020).
"3M Organic Vapor/Acif Gas Cartridge/Filter 60923, P100 Respiratory Protection (Pack of 2)," by 3M, Amazon.com (Dec. 6, 2020).

* cited by examiner

DUAL FILTRATION COVID-19 MASK

SUMMARY

A dual filtration Coronavirus-19 (COVID-19) mask is provided.

A dual filtration COVID-19 mask includes: an intake valve panel comprising one or more intake valves, the intake valve panel positioned in an approximate center of the mask, the intake valves configured to open to transmit a user's intake breath, the intake valves further configured to close promptly after transmission of the user's intake breath and prior to the user's next exhale breath, the intake valve panel further comprising an intake filter configured to filter the user's intake breath; one or more exhaust valves, the one or more exhaust valves positioned to a side of the mask, the exhaust valves configured to open to transmit the user's exhale breath, the exhaust valves further configured to close promptly after transmission of the user's exhale breath and prior to the user's next intake breath; one or more exhaust tubes, at least one of the one or more exhaust tubes comprising at least one of the exhaust valves, at least one of the exhaust tubes configured to conduct the user's exhale breath through the at least one of the exhaust valves and then out of the mask, at least one exhaust tube holding the at least one exhaust valve tightly while allowing the at least one exhaust valve to open and close freely; a soft foam lining configured to tightly hold the mask against the user's face; and a hard foam lining attached to the mask, the hard foam lining attached to the soft foam lining, the hard foam lining configured to hold the intake valve panel at a distance from the user's face, thereby allowing the intake valves to open and close freely.

A dual filtration COVID-19 mask includes: an intake valve panel comprising exactly four valves, the intake valve panel positioned in an approximate center of the mask, each of the intake valves configured to open to transmit a user's intake breath, each of the intake valves further configured to close promptly after transmission of the user's intake breath and prior to the user's next exhale breath, the intake valve panel further comprising an intake filter configured to filter the user's intake breath; one or more exhaust valves configured to open to transmit the user's exhale breath, the one or more exhaust valves positioned to a side of the mask, each of the exhaust valves further configured to close promptly after transmission of the user's exhale breath and prior to the user's next intake breath; one or more exhaust tubes, at least one of the one or more exhaust tubes comprising at least one of the exhaust valves, at least one of the exhaust tubes configured to conduct the user's exhale breath through the at least one of the exhaust valves and then out of the mask, at least one exhaust tube holding the at least one exhaust valve tightly while allowing the at least one exhaust valve to open and close freely; a soft foam lining configured to tightly hold the mask against the user's face; a base configured firmly to hold the intake valve panel and at least one of the exhaust tubes, wherein at least one exhaust tube passes through the base to an outside of the mask, so as to conduct the user's exhale breath out through the exhaust tube, wherein at least one exhaust tube further comprises an exhaust filter configured to filter the user's exhale breath, wherein the exhaust filter attaches to an end of the exhaust tube opposite the exhaust tube end comprising the exhaust valve, wherein the exhaust valve comprises an exhaust valve diameter slightly smaller than an exhaust tube diameter of the exhaust tube; and a hard foam lining attached to the soft foam lining, the hard foam lining attached to the base on an opposite side of the hard foam lining from the soft foam lining, the hard foam lining configured to hold the intake valve panel at a distance from the user's face, thereby allowing the intake valves to open and close freely.

A dual filtration COVID-19 mask configured to allow a user to breathe includes: an intake valve panel comprising exactly four intake valves, the intake valve panel positioned in an approximate center of the mask, each of the intake valves comprising check valves, each of the intake valves configured to open to transmit a user's intake breath, each of the intake valves further configured to close promptly after transmission of the user's intake breath and prior to the user's next exhale breath; an intake filter configured to filter the user's intake breath, the intake filter attached to the intake valve panel, the intake filter positioned adjacent to and outside of the intake valve panel; one or more exhaust valves configured to open to transmit the user's exhale breath, the one or more exhaust valves positioned to a side of the mask, each of the exhaust valves comprising check valves, each of the exhaust valves further configured to close promptly after transmission of the user's exhale breath and prior to the user's next intake breath, wherein each of the exhaust valves is located approximately three-eighths of an inch from the end of the exhaust tube opposite the exhaust tube end comprising the exhaust valve; one or more exhaust tubes, at least one of the one or more exhaust tubes comprising at least one of the exhaust valves, at least one of the exhaust tubes configured to conduct the user's exhale breath through the at least one of the exhaust valves and then out of the mask, at least one exhaust tube holding the at least one exhaust valve tightly while allowing the at least one exhaust valve to open and close freely; a soft foam lining configured to tightly hold the mask against the user's face; a base configured firmly to hold the intake valve panel and at least one of the exhaust tubes, wherein at least one exhaust tube passes through the base to an outside of the mask, so as to conduct the user's exhale breath out through the exhaust tube, wherein at least one exhaust tube further comprises an exhaust filter configured to filter the user's exhale breath, wherein the exhaust filter attaches to an end of the exhaust tube opposite the exhaust tube end comprising the exhaust valve, wherein the exhaust valve comprises an exhaust valve diameter slightly smaller than an exhaust tube diameter of the exhaust tube, the base further comprising at least one anchor configured to hold the mask base in place on the mask; an intake filter slot configured to receive the intake filter, the intake filter slot further configured to hold the intake filter firmly in place; and a hard foam lining attached to the base on an opposite side of the hard foam lining from the soft foam lining, the hard foam lining configured to hold the intake valve panel at a distance from the user's face.

DESCRIPTION OF THE DRAWINGS

The accompanying drawings provide visual representations which will be used to more fully describe various representative embodiments and can be used by those skilled in the art to better understand the representative embodiments disclosed herein and their inherent advantages. In these drawings, like reference numerals identify corresponding elements.

DETAILED DESCRIPTION

Figure 1A:
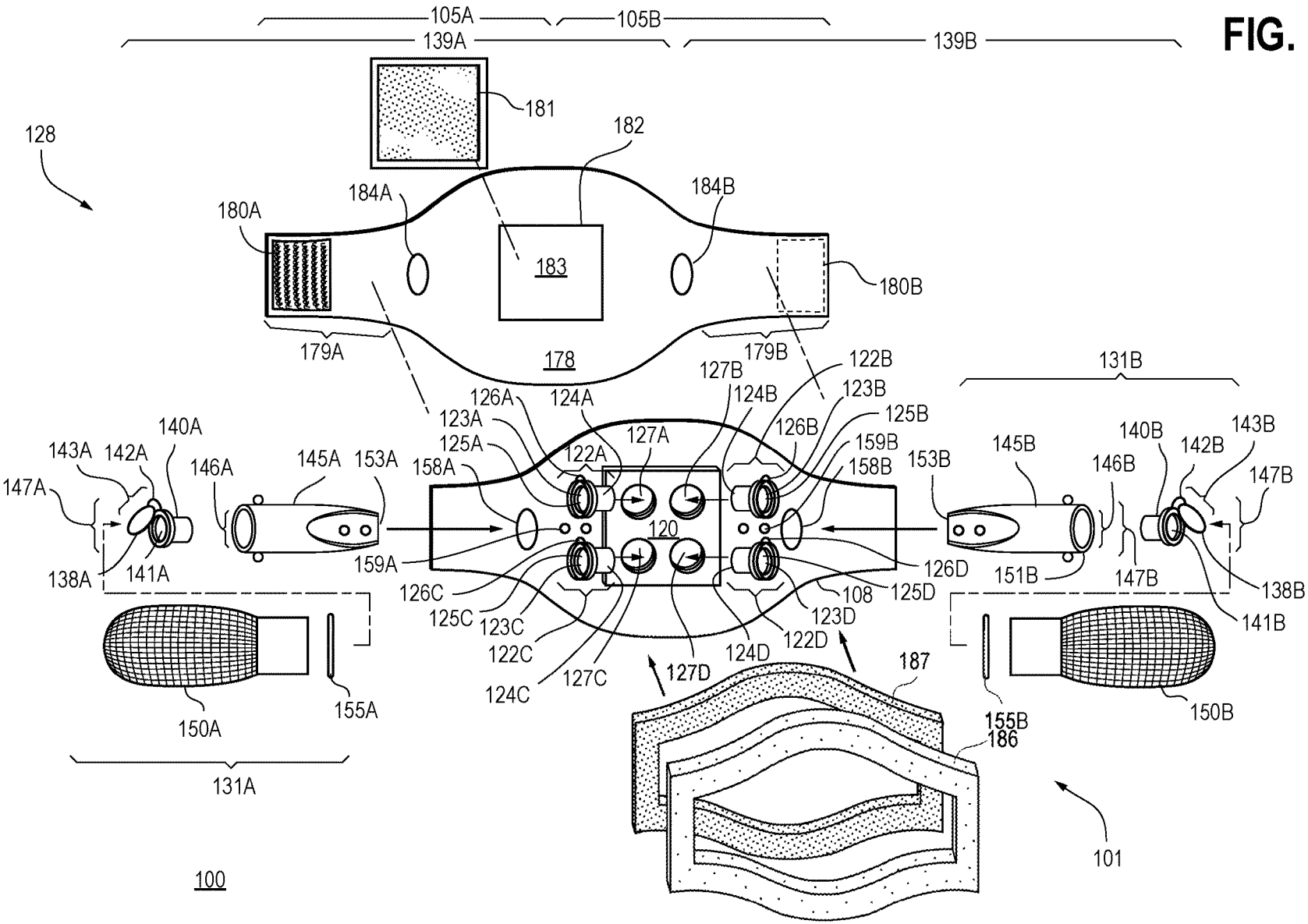
FIGS. 1A-1C are a set of three drawings showing an exploded interior view and assembled interior and exterior views of a dual filtration COVID-19.

Embodiments of the invention provide a dual filtration COVID-19.

The dual filtration COVID-19 mask allows the user to breathe fresh air in and to exhale through one or more exhaust valves that are positioned a relatively long distance from the intake valve panel comprising the intake valves, so as to prevent the user from inadvertently breathing on the intake breath a substantial amount of air that has been exhaled on a prior exhale breath. Embodiments of the invention allow fresh air to enter through one or more intake valves, preferably but not necessarily comprising one or more check valves, which open when the user is inhaling and close when the user is exhaling. Further embodiments of the invention comprise exhaust valves comprising one or more check valves, which open when the user is exhaling and close when the user is inhaling. A hard foam lining of the mask holds the intake valve panel at a distance from the user's face, thereby allowing the intake valves to open and close freely.

Typically, although not necessarily, and as depicted, the check valve has a shape that is one or more of generally circular, generally oval, and generally elliptical. Typically, although not necessarily, and as depicted, the check valve comprises two small, round hinges configured to allow the valve to open and close freely while not allowing the check valve to move from side to side. A representative dimension of the check valve hinge is approximately a quarter inch. The check valve hinge comprises one or more of copper and a flexible material.

The mask further comprises a base. The base comprises one or more of cardboard, plastic and other materials. For example, the base comprises molded plastic. For example, the base comprises molded, hypoallergenic plastic. The base is firm so as to hold the one-way check valves when they are inserted into the base and secured there. For example, the one-way check valves are secured to the base using one or more of double stick tape and glue.

The base can be constructed using cardboard. Disposable models will typically comprise a cardboard base. Inch-long slices are cut into the cardboard and placed on the top of the cardboard cutout. When pulled together and then fastened with glue or staples, the slices help create a dome-shaped base that fits snugly over the face.

The base will also house the exhaust tubes that in turn hold the one-way exhaust check valves at an exhaust end of the exhaust tube where the exhaust emerges from the exhaust tube. For example, the exhaust check valves are located approximately three-eighths of an inch (⅜ inches) from an exhaust end of the exhaust tube. Accordingly, any chance that the exhaust filter may interfere with the exhaust tube is reduced. Alternatively, or additionally, the exhaust check valves are located at the exhaust end of the exhaust tube.

The exhaust tube passes through the cardboard cutout and is fastened with a staple close to the mouth and can vary in size according to the need to exhale. The other ends of the exhaust tubes coming out of the mask base support the exhaust filters, which attach to the end of the exhaust tubes to filter any exhale coming out of the side of the mask.

The base is also designed to hold one or more of a hard foam lining and a soft foam lining. One or more of the hard foam lining and the soft foam lining create a gap between the one-way check valves and one or more of the user's face and the user's lips. The hard foam lining is configured to hold the intake valve panel at a distance from the user's face. Accordingly, the hard foam lining prevents a user's eyeglasses from steaming up while the user is wearing the mask.

The covering of the face mask is made up of neoprene rubber or other substances with elastic benefits, which is very similar to a snow ski face mask for cold weather. The mask covers the cardboard mask base and is attached to the base, while the cover adheres the mask to the face by attaching together behind the back of the head with Velcro, snapping, or other fastening methods. For the inexpensive and disposable models, the face mask can also be attached behind the ears with an elastic string.

The mask base also holds the exhaust tubes. Preferably, but not necessarily, and as depicted, the exhaust filter is attached to the exhaust tube. Preferably, but not necessarily, and as depicted, an exhaust filter fastener holds the exhaust tube against the mask base. Preferably, but not necessarily, and as depicted, the exhaust filter fastener comprises an elastic band. For example, the exhaust filter fastener comprises a rubber band. The mask base further comprises an intake filter configured to filter a user's intake breath. Preferably, but not necessarily, and as depicted, the intake filter slides in front of the intake valves.

The intake filter is one or more of disposable and washable. For example, an intake filter comprising four intake valves has approximate dimensions of 2"×2." Dimensions of the intake filter may vary according to one or more of a mask size and a number of intake valves. The intake filter can comprise multiple filtration materials such as a copper mesh. The copper mesh may provide more protection against one or more of viruses and bacteria.

Exhaust filters attach to exhaust tubes protruding from each side of the face mask. The exhaust filters are configured to filter exhaust emerging from the mask on an exhale by the user. The tubes stick out sufficiently for an elastic end of the exhaust filters to fit snugly on the respective exhaust tubes. The exhaust filter may comprise a copper mesh. The exhaust filter is one or more of disposable and washable. The other end of the exhaust filters are attached to the face covering on each side towards the ear with velcro, snaps, or other fastening devices.

For example, the base comprises cardboard. As described below in more detail in FIGS. 5A-5H, the cardboard base may be constructed by cutting in the base a pair of slices having a length of approximately one inch, and subsequently, by pulling two sides of the mask base together, thereby creating a three-dimensional, domed base. The dome of the mask accommodates a user's mouth. Then one or more of a hard foam lining and a soft foam lining is attached around edges of an inner side of the base. The one or more of the hard foam lining and the soft foam lining helps to keep the mask a distance from lips of the user so that the intake valves are held at a distance from the user's lips.

The exhaust valves have an exhaust valve diameter that is slightly less than an exhaust tube diameter. The exhaust valves are located just inside an end of the respective exhaust tube, for example, approximately ⅜ of an inch from the end of the respective exhaust tube comprising the respective exhaust filter.

Optionally, embodiments of the invention further comprise a sterilization box usable to store one or more dual filtration COVID-19 masks. The sterilization box comprises dimensions comfortably exceeding dimensions of the one or more masks stored in the sterilization box. For example, the sterilization box is usable to store the dual filtration COVID-19 mask at night while it is not being used. For example, the sterilization box comprises an ultraviolet sterilization box configured to use ultraviolet radiation to do one or more of sanitize the mask and sterilize the mask. For example, the sterilization box is usable to do one or more of store the mask, transport the mask, ship the mask, sanitize the mask, and sterilize the mask. The sterilization box may be powered using one or more of non-rechargeable batteries, rechargeable batteries, and another power source.

Figure 1B:
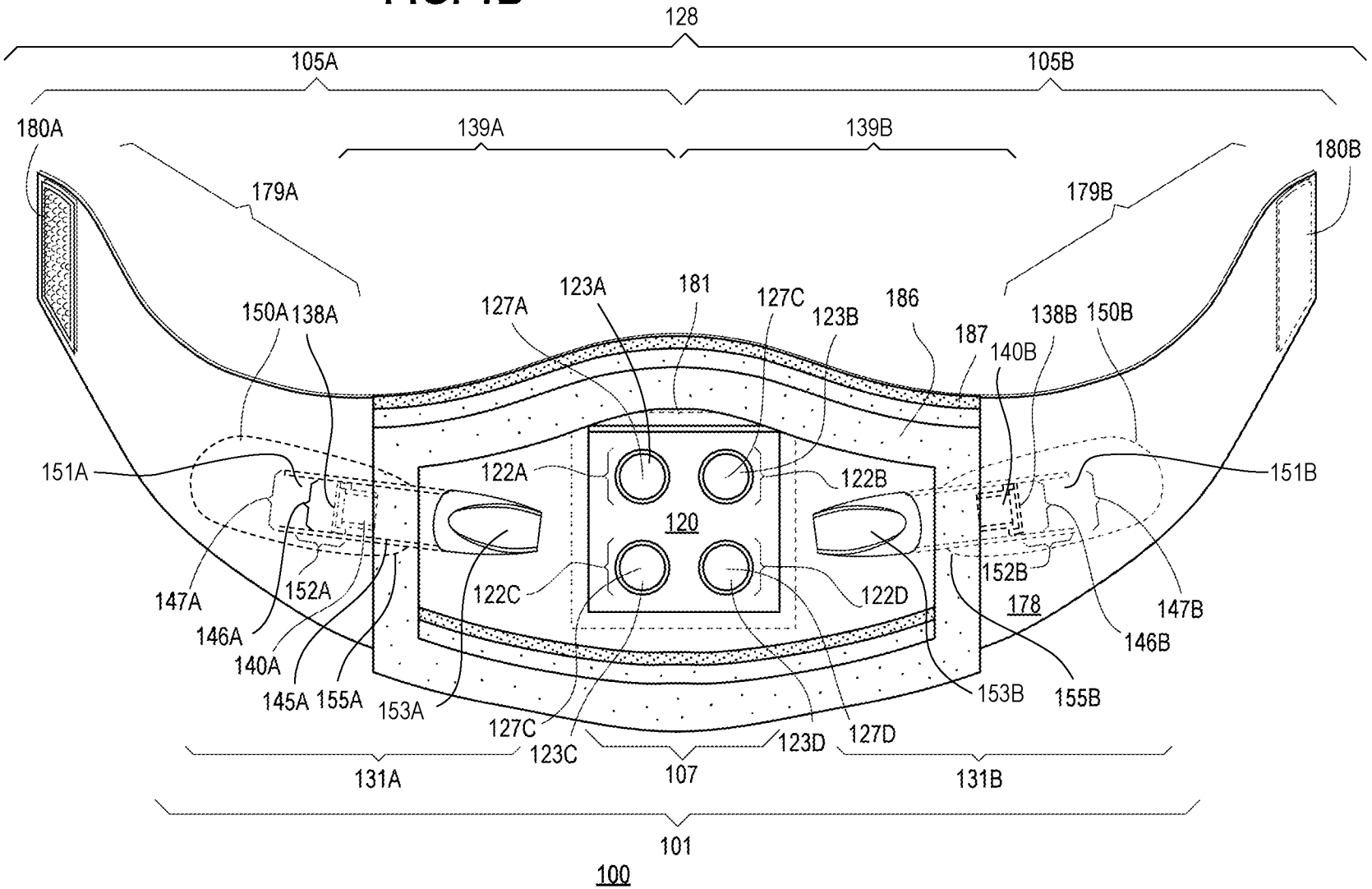
Figure 1C:
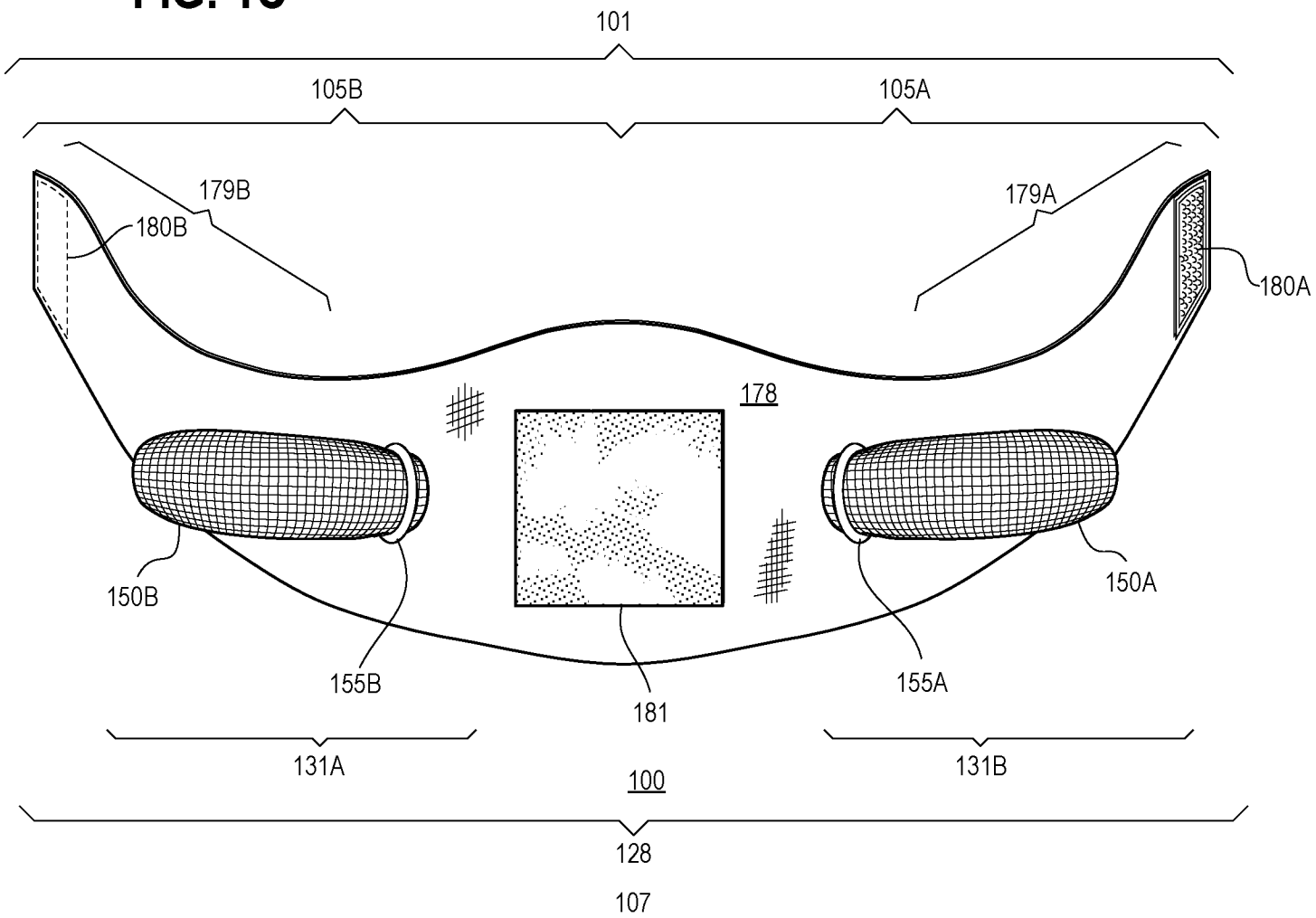

FIGS. 1A-1C are a set of three drawings showing an exploded view and assembled interior and exterior views of a dual filtration COVID-19 mask 100.

FIG. 1A is a drawing showing an exploded view of the dual filtration COVID-19 mask 100 as seen from an inside 101 of the mask 100. The mask 100 is configured to allow the user (not shown) to breathe, showing the mask 100 prior to use. The mask 100 comprises a mask left side 105A, a mask right side 105B (the "left side" and "right side" descriptors are as seen in the interior views shown in this figure and in FIG. 1B), and a mask center 107.

The mask 100 further comprises a mask base 108. For example, the mask base 108 comprises cardboard. For example, the mask base 108 comprises plastic. For example, the mask base 108 comprises hard plastic.

The mask base 108 comprises an intake valve panel 120 configured to transmit a user's intake breath. The intake valve panel 120 is further configured to protect one or more of the user (not shown) and others from one or more of COVID-19 and another disease by filtering the user's intake breath to do one or more of provide protection from respiratory disease pathogens and remove respiratory disease pathogens. Preferably, but not necessarily, and as depicted, the intake valve panel 120 is approximately positioned at the mask center 107. The intake valve panel 120 comprises one or more intake valve assemblies 122A-122D.

At least one of the intake valve assemblies 122A-122D comprises a respective intake valve 123A-123D, at least one of the one or more intake valves 123A-123D configured to open to transmit the user's intake breath. Preferably, but not necessarily, and as depicted, each of the intake valves assemblies 122A-122D comprises a respective intake valve 123A-123D. At least one of the one or more intake valves 123A-123D is configured to open to transmit the user's intake breath. Preferably, but not necessarily, and as depicted, each of the one or more intake valves 123A-123D is configured to open to transmit the user's intake breath. Preferably, but not necessarily, and as depicted, each of the intake valves 123A-123D is configured to close promptly after transmission of the user's intake breath. At least one of the one or more intake valves 123A-123D is configured to spring back into place after transmission of the user's intake breath. Preferably, but not necessarily, and as depicted, each of the intake valves 123A-123D is configured to spring back into place after transmission of the user's intake breath. As depicted, the intake valve panel 120 comprises a first intake valve 123A, a second intake valve 123B, a third intake valve 123C, and a fourth intake valve 123D. The intake valves 123A-123D are closed because the user is not currently breathing an intake breath.

Preferably, but not necessarily, and as depicted, at least one of the intake valves 123A-123D has a shape that is one or more of generally circular, generally oval, and generally elliptical. Preferably, but not necessarily, and as depicted, each of the intake valves 123A-123D has a shape that is one or more of generally circular, generally oval, and generally elliptical.

For example, at least one of the intake valves 123A-123D comprises a check valve. Preferably, but not necessarily, and as depicted, each of the intake valves 123A-123D comprises a check valve. Optionally, at least one of the intake valves 123A-123D comprises a small intake valve locking tab (not shown in the figure) configured to stop the intake valve 123A-123D from moving close to a user's mouth (not shown in the figure). The intake valve locking tab (not shown in this figure) helps in assembly of the mask 100.

At least one of the intake valves 123A-123D is attached to the intake valve panel 120. Preferably, each of the intake valves 123A-123D is attached to the intake valve panel 120. For example, one or more of the intake valves 123A-123D is attached to the intake valve panel 120 using one or more of double stick tape and glue.

At least one of the intake valve assemblies 122A-122D further comprises a respective intake valve base 124A-124D. Preferably, but not necessarily, and as depicted, each of the intake valve assemblies 122A-122D further comprises a respective intake valve base 124A-124D.

At least one of the intake valve assemblies 122A-122D further comprises a respective intake valve base 124A-124D, the respective intake valve base 124A-124D configured to hold the respective intake valve 123A-123D while allowing the respective intake valve 123A-123D to open and close as needed. Preferably, but not necessarily, and as depicted, each of the intake valve assemblies 122A-122D further comprises a respective intake valve base 124A-124D.

At least one of the intake valves 123A-123D further comprises an intake valve base hole 125A-125D, the intake valve base hole 125A-125D configured to allow the user's intake breath to pass through the respective intake valve base 124A-124D and then through a respective open intake valve 123A-123D. At least one of the intake valves 123A-123D is attached to the corresponding intake valve base 124A-124D by a corresponding intake valve hinge 126A-126D. Preferably, but not necessarily, and as depicted, each of the intake valves 123A-123D is attached to the corresponding intake valve base 124A-124D by a corresponding intake valve hinge 126A-126D. At least one of the intake valves 123A-123D opens using the corresponding intake valve hinge 126A-126D to transmit the user's intake breath. Preferably, but not necessarily, and as depicted, each of the intake valves 123A-123D opens using the corresponding intake valve hinge 126A-126D to transmit the user's intake breath. After transmission of the user's intake breath, at least one of the intake valves 123A-123D closes using the corresponding intake valve hinge 126A-126D. Preferably, but not necessarily, and as depicted, each of the intake valves 123A-123D closes using the corresponding intake valve hinge 126A-126D.

The intake valve panel 120 further comprises one or more base intake holes 127A-127D, wherein at least one of the base intake holes 127A-127D is configured snugly to hold a corresponding intake valve 123A-123D while allowing the user's intake breath to pass from an outside 128 of the mask 100 to the inside 101 of the mask 100. Preferably, but not necessarily, and as depicted, each of the base intake holes 127A-127D is configured to snugly hold the corresponding intake valve 123A-123D while allowing the user's intake breath to pass from the outside 128 of the mask 100 to the inside 101 of the mask 100.

Preferably, but not necessarily, and as depicted, at least one of the intake valves 123A-123D comprises a one-way intake valve 123A-123D configured to allow passage of the user's intake breath (not shown) from the outside 128 of the mask 100 to the inside 101 of the mask. Preferably, but not necessarily, and as depicted, each of the intake valves 123A-123D comprises a one-way intake valve 123A-123D configured to allow passage of the user's intake breath from the outside 128 of the mask 100 to the inside 101 of the mask.

The mask base 108 further comprises a left exhaust valve assembly 131A positioned on the left side 105A of the mask 100. The mask 100 further comprises a right exhaust valve assembly 131B positioned on the right side 105B of the mask 100.

The left exhaust valve assembly 131A comprises a left exhaust valve 138A. The right exhaust valve assembly 131B further comprises a right exhaust valve 138B. One or more of the left exhaust valve 138A and the right exhaust valve 138B are configured to open to transmit the user's exhale breath. Preferably, but not necessarily, and as depicted, both the left exhaust valve 138A and the right exhaust valve 138B are configured to open to transmit the user's exhale breath. At least one of the one or more exhaust valves 138A-138B is configured to close promptly after transmission of the user's exhale breath. One or more of the left exhaust valve 138A and the right exhaust valve 138B are configured to close promptly after transmission of the user's exhale breath. Preferably, but not necessarily, and as depicted, each of the exhaust valves 138A-138B is configured to close promptly after transmission of the user's exhale breath. To clarify their functionality, the exhaust valves 138A-138B are shown as partially open in this exploded view but upon installation, will be closed until the user's first intake breath occurs. The left exhaust valve 138A is secured to the base 108. The right exhaust valve 138B is secured to the base 108. For example, one or more of the left exhaust valve 138A and the right exhaust valve 138B is secured to the base 108 using one or more of double stick tape and glue.

Preferably, but not necessarily the exhaust valves 138A-138B are positioned at respective exhaust-intake distances 139A-139B from the intake valve panel 120 comprising the intake valves 123A-123D. The left exhaust valve 138A is position at a left exhaust-intake distance 139A from the intake valve panel 120, and the right exhaust valve 138B is positioned at a right exhaust-intake distance 139B from the intake valve panel. Preferably, but not necessarily, and as depicted, the left exhaust-intake valve distance 139A is approximately equal to the right exhaust-intake valve distance 139B. The respective exhaust-intake distances 139A-139B are relatively long, so as to prevent the user (not shown) from inadvertently breathing on the intake breath a substantial amount of air that has been exhaled on a prior exhale breath.

Preferably, but not necessarily, and as depicted, at least one of the exhaust valves 138A-138B comprises a one-way exhaust valve 138A-138B configured to allow passage of the user's intake breath (not shown) from the inside 101 of the mask 100 to the outside 128 of the mask. Preferably, but not necessarily, and as depicted, each of the exhaust valves 138A-138B comprises a one-way exhaust valve 138A-138B configured to allow passage of the user's intake breath (not shown) from the inside 101 of the mask 100 to the outside 128 of the mask.

The left exhaust valve assembly 131A further comprises a left exhaust valve base 140A, the left exhaust valve base 140A configured to hold the left exhaust valve 138A while allowing the left exhaust valve 138A to open and close as needed. The left exhaust valve base 140A comprises a left exhaust valve base hole 141A in an approximate center of the left exhaust valve base 140A, the left exhaust valve base hole 141A configured to allow the user's exhale breath to pass through the left exhaust valve base 140A and then through an open left exhaust valve 138A. The right exhaust valve assembly 131B further comprises a right exhaust valve base 140B, the right exhaust valve base 140B configured to hold the right exhaust valve 138B while allowing the right exhaust valve 138B to open and close as needed. The right exhaust valve base 140B comprises a right exhaust valve base hole 141B in an approximate center of the right exhaust valve base 140B, the right exhaust valve base hole 141B configured to allow the user's exhale breath to pass through the right exhaust valve base 140B and then through an open right exhaust valve 138B.

The left exhaust valve 138A is attached to the left exhaust valve base 140A by a left exhaust valve hinge 142A. The left exhaust valve 138A opens using the left exhaust valve hinge 142A to transmit the user's exhale breath. After transmission of the user's exhale breath, the left exhaust valve 138A closes using the left exhaust valve hinge 142A. The right exhaust valve 138B is attached to the right exhaust valve base 140B by a right exhaust valve hinge 142B. The right exhaust valve 138B opens using the right exhaust valve hinge 142B to transmit the user's exhale breath. After transmission of the user's exhale breath, the right exhaust valve 138B closes using the right exhaust valve hinge 142B.

The mask 100 thus comprises the intake valve panel 120 positioned at the approximate mask center 107 and the left and right exhaust valves 138A-138B respectively positioned on the left and right sides 105A-105B of the mask 100. Accordingly, the mask 100 helps ensure that the user is not breathing the user's own exhaust. The mask 100 also helps ensure that the user has substantially no carbon dioxide intake. The user can use the mask 100 without fogging eyeglasses of the user. The base 108 is configured firmly to hold the intake valve panel 120.

Preferably, but not necessarily, and as depicted, at least one of the exhaust valves 138A-138B has a shape that is one or more of generally circular, generally oval, and generally elliptical. Preferably, but not necessarily, and as depicted, each of the exhaust valves 138A-138B has a shape that is one or more of generally circular, generally oval, and generally elliptical. For example, at least one of the left exhaust valve 138A and the right exhaust valve 138B comprises a check valve. Preferably, but not necessarily, and as depicted, both the left exhaust valve 138A and the right exhaust valve 138B comprise a check valve. The left exhaust valve 138A comprises a left exhaust valve diameter 143A. The right exhaust valve 138B comprises a right exhaust valve diameter 143B.

The left exhaust valve assembly 131A further comprises a left exhaust tube 145A located on the left side 105A of the mask 100. The right exhaust valve assembly 131B further comprises a right exhaust tube 145B located on the right side 105B of the mask 100. Preferably, but not necessarily, and as depicted, the left exhaust tube 145A comprises the left exhaust valve 138A. Preferably, but not necessarily, and as depicted, the right exhaust tube 145B comprises the right exhaust valve 138B. Preferably, but not necessarily, and as depicted, the left exhaust valve 138A is located just inside the left exhaust tube 145A. Preferably, but not necessarily, and as depicted, the right exhaust valve 138B is located just inside the right exhaust tube 145B. The left exhaust valve 138A and the right exhaust valve 138B are closed because the user is not currently breathing an exhale breath. At least one of the exhaust tubes 145A-145B passes through the base 108 to the outside 128 of the mask, so as to conduct the user's exhale breath out through the respective exhaust tube 140A-140B. Preferably, but not necessarily, and as depicted, both of the exhaust tubes 145A-145B pass through the base 108 to the outside 128 of the mask, so as to conduct the user's exhale breath out through the respective exhaust tubes 140A-140B.

The left exhaust tube 145A comprises a left exhaust tube inner diameter 146A. The right exhaust tube 145B comprises a right exhaust tube inner diameter 146B. The left exhaust tube 145A further comprises a left exhaust tube outer diameter 147A. The right exhaust tube 145B further comprises a right exhaust tube outer diameter 147B. Preferably, but not necessarily, and as depicted, the left exhaust valve diameter 143A is roughly equal to and very slightly less than the left exhaust tube inner diameter 146A so that the left exhaust valve 138A fits snugly inside the left exhaust tube 145A. Accordingly, the left exhaust tube 145A allows the left exhaust valve 138A to open and close freely while holding the left exhaust valve 138A tightly. Preferably, but not necessarily, and as depicted, the right exhaust valve diameter 143B is roughly equal to and very slightly less than the right exhaust tube inner diameter 146B so that the right exhaust valve 138B fits snugly inside the right exhaust tube 145B. Accordingly, the right exhaust tube 145B allows the right exhaust valve 138B to open and close freely while holding the right exhaust valve 138B tightly. The base 108 is further configured firmly to hold at least one of the exhaust tubes 145A-145B. Preferably, but not necessarily, and as depicted, the base 108 holds both of the exhaust tubes 145A-145B.

For example, the left exhaust valve diameter 143A equals approximately five-eighths (⅝) of an inch. For example, the left exhaust tube inner diameter 146A equals approximately five-eighths (⅝) of an inch. For example, the left exhaust tube outer diameter 147A equals approximately three-fourths (¾) of an inch.

For example, the right exhaust valve diameter 143B equals approximately five-eighths (⅝) of an inch. For example, the right exhaust tube inner diameter 146B equals approximately five-eighths (⅝) of an inch. For example, the right exhaust tube outer diameter 147B equals approximately three-fourths (¾) of an inch.

Preferably, but not necessarily, and as depicted, one or more of the left exhaust tube 145A and the right exhaust tube 145B comprises hard plastic or other material. Preferably, but not necessarily, and as depicted, both the left exhaust tube 145A and the right exhaust tube 145B comprises hard plastic or other material. For example, one or more of the left exhaust tube 145A and the right exhaust tube 145B comprise one or more of transparent material and translucent material. Preferably, both the left exhaust tube 145A and the right exhaust tube 145B comprise one or more of transparent material and translucent material. Accordingly, the mask 100 can be placed in a sterilization box (not shown) where it can be sterilized using ultraviolet light.

The left exhaust tube 145A further comprises a left exhaust filter 150A. Preferably, the left exhaust filter 150A is physically attached to the left exhaust tube 145A. A first portion (not shown) of the user's exhale breath (not shown) leaves the left exhaust tube 145A and enters the left exhaust filter 150A, the left exhaust filter 150A configured to filter the first portion of the user's exhale breath through the left exhaust tube 145A.

The right exhaust tube 145B further comprises a right exhaust filter 150B. Preferably, the right exhaust filter 150B that is physically attached to the right exhaust tube 145B. A second portion (not shown) of the user's exhale breath (not shown) leaves the right exhaust tube 145B and enters the right exhaust filter 150B, the right exhaust filter 150B configured to filter the second portion of the user's exhale breath through the right exhaust tube 145B. The exhaust filters 145A-145B are configured to protect one or more of the user and others from one or more of COVID-19 and another disease by filtering the user's exhaust breath.

Preferably, but not necessarily, and as depicted, one or more of the left exhaust filter 150A and the right exhaust filter 150B comprises a cloth tube configured to fit tightly onto the respective left exhaust tube 145A and the right exhaust tube 145B. Preferably, but not necessarily, and as depicted, the left exhaust filter 150A comprises a cloth tube configured to fit tightly onto the left exhaust tube 145A. Preferably, but not necessarily, and as depicted, the right exhaust filter 150B comprises a cloth tube configured to fit tightly onto the right exhaust tube 145B.

The left exhaust tube 145A further comprises a left exhaust tube exhaust end 151A that is close to the left exhaust valve 138A, the exhaust emerging from the left exhaust tube 145A at the left exhaust tube exhaust end 151A. The right exhaust tube 145B further comprises a right exhaust tube exhaust end 151B that is close to the right exhaust valve 138B, the exhaust emerging from the right exhaust tube 145A at the right exhaust tube exhaust end 151B. The left exhaust tube exhaust end 151A is located at a left valve to end distance 152A from the left exhaust valve 138A. The right exhaust tube exhaust end 151B is located at a right valve to end distance 152B from the right exhaust valve 138B.

For example, the left valve to end distance 152A of the left exhaust valve 138A from the left exhaust tube exhaust end 151A comprising the left exhaust tube 145A is approximately three-eighths of an inch (⅜ inches). Alternatively, or additionally, the left valve to end distance 152A equals zero.

For example, the right valve to end distance 152B of the right exhaust valve 138B from the right exhaust tube exhaust end 151B comprising the right exhaust tube 145B is approximately three-eighths of an inch (⅜ inches). Alternatively, or additionally, the right valve to end distance 152B equals zero.

The left exhaust filter 150A is attached to the left exhaust tube 145A near the left exhaust tube exhaust end 151A. The right exhaust filter 150B is attached to the right exhaust tube 145A near the right exhaust tube exhaust end 151B.

The left exhaust tube 145A further comprises a left exhaust tube base end 153A that is close to the mask base 108. The right exhaust tube 145B further comprises a right exhaust tube base end 153B that is close to the mask base 108.

Preferably, but not necessarily, and as depicted, the left exhaust filter 150A comprises a left exhaust filter fastener 155A configured to fasten the left exhaust filter 150A onto the left exhaust tube 145A. Preferably, but not necessarily, and as depicted, the right exhaust filter 150B comprises a right exhaust filter fastener 155B configured to fasten the right exhaust filter 150B onto the right exhaust tube 145B. Preferably, but not necessarily, and as depicted, the left exhaust filter fastener 150A holds the left exhaust tube 145A against the mask base 108. Preferably, but not necessarily, and as depicted, the left exhaust filter fastener 155A comprises an elastic band. For example, and as depicted, the left exhaust filter fastener 155A comprises an elastic band 155A circling a circumference of the left exhaust tube 150A near an end of the left exhaust tube 150A. For example, the left exhaust filter fastener 155A comprises a rubber band. Preferably, but not necessarily, and as depicted, the right exhaust filter fastener 155B holds the right exhaust tube 145B against the mask base 108. Preferably, but not necessarily, and as depicted, the right exhaust filter fastener 155B comprises an elastic band. For example, and as depicted, the right exhaust filter fastener 155B comprises an elastic band 155B circling a circumference of the right exhaust tube 150B near an end of the right exhaust tube 150B. For example, the right exhaust filter fastener 155B comprises a rubber band.

The mask base 108 further comprises a left base exhaust hole 158A configured to allow the left exhaust tube 145A to pass through from the inside 101 of the mask 100 to the outside 128 of the mask 100. For example, the left base exhaust hole 158A comprises an opening slightly larger than a diameter of the left exhaust tube 145A. The mask base 108 further comprises a right base exhaust hole 158B configured to allow the right exhaust tube 145B to pass through from the inside 101 of the mask 100 to the outside 128 of the mask 100. For example, the right base exhaust hole 158B comprises an opening slightly larger than a diameter of the right exhaust tube 145B.

The mask base 108 further comprises one or more of a left base anchor 159A located on the left side 105A of the mask 100 and a right base anchor 159B located on the right side 105B of the mask. Preferably, but not necessarily, and as depicted, the mask base 108 comprises both the left base anchor 159A and the right base anchor 159B. At least one of the left base anchor 159A and the right base anchor 159B is configured to hold the mask base 108 in place on the mask 100. Preferably, but not necessarily, the left base anchor 159A and the right base anchor 159B are both configured to hold the mask base 108 in place on the mask 100. For example, the left base anchor 159A comprises one or more of a fastener, a rivet, and a staple. As depicted, the left base anchor 159A comprises a staple. For example, the right base anchor 159B comprises one or more of a fastener, a rivet, and a staple. As depicted, the right base anchor 159B comprises a staple.

The mask 100 further comprises a mask cover 178 configured to cover the outside 128 of the mask 100. The mask cover 178 is attached to the mask base 108. Preferably, but not necessarily, and as depicted, the mask base 108 is stapled to the mask cover 178. Alternatively, or additionally, the mask base 108 is attached to the mask cover 178 using one or more of a rivet, glue, and tape.

The mask cover 178 comprises one or more of a left strap 179A and a right strap 179B. Preferably, but not necessarily, and as depicted, the mask cover 178 comprises both the left strap 179A and the right strap 179B. The left strap 179A comprises a left strap connector 180A. The right strap 179B comprises a right strap connector 180B. The left strap connector 180A and the right strap connector 180B are connectable to hold the mask 100 on the user's face (not shown). One or more of the left strap connector 180A and the right strap connector 180B comprises a connector configured to connect the left strap 179A to the right strap 179B while the user (not shown) is wearing the mask. For example, one or more of the left strap connector 180A and the right strap connector 180B comprise Velcro usable to connect the left strap 179A and the right strap 179B. Preferably, but not necessarily, and as depicted, both the left strap connector 180A and the right strap connector 180B comprise Velcro usable to connect the left strap 179A and the right strap 179B.

The mask cover 178 further comprises an intake filter 181 configured to filter the user's intake breath through the intake valve panel 120. As depicted, the intake filter 181 is attached to the intake valve panel 120. As depicted, the intake filter 181 is positioned adjacent to and outside of the intake valve panel 120. For example, the mask cover 178 comprises an intake filter slot 182 configured to hold the intake filter 181. Preferably, but not necessarily, and as depicted, the intake filter 181 slides in front of the intake valve panel 120 so as to filter the user's intake breath. The intake filter 181 may be one or more of disposable and washable. For example, an intake filter 181 comprising four intake valves 123A-123D has approximate dimensions of 2"×2." Dimensions of the intake valve panel 120 may vary according to one or more of a size of the mask 100 and a number of intake valves 123A-123D in the intake valve panel 120. The intake filter 181 can comprise multiple filtration materials such as one or more of a disposable filter of any kind and a copper mesh. The copper mesh may provide more protection against one or more of viruses and bacteria.

The mask cover 178 further comprises an intake filter slot 182 configured to receive the intake filter 181, the intake filter slot 182 further configured to hold the intake filter 181 firmly in place.

The mask base 108 further comprises an optional intake valve spacer (not shown). The intake valve spacer (not shown) prevents the intake filter 181 from contacting the intake valves 120, making the intake filter 181 easier to install.

The mask cover 178 further comprises an intake hole 183 configured to allow the user's intake breath (not shown) to pass from the outside 128 of the mask 100 to the intake valve panel 120 and then through the intake filters 123A-123D to the inside 101 of the mask 100. The mask cover 178 further comprises a left cover exhaust hole 184A configured to allow the left exhaust tube 145A to pass through from the inside 101 of the mask 100 to an outside 128 of the mask 100. For example, the left cover exhaust hole 184A comprises an opening slightly larger than a diameter of the left exhaust tube 145A. The mask cover 178 further comprises a right cover exhaust hole 184B configured to allow the right exhaust tube 145B to pass through from the inside 101 of the mask 100 to the outside 128 of the mask 100. For example, the right cover exhaust hole 184B comprises an opening slightly larger than a diameter of the right exhaust tube 145B.

The mask 100 further comprises a soft foam lining 186 configured to comfortably hold the mask 100 against the user's face (not shown). The soft foam lining 186 is attached to the mask base 108. For example, the soft foam lining 186 is attached to the mask base 108 using one or more of tape and glue.

The mask 100 further comprises a hard foam lining 187 attached to the mask 100, the hard foam lining 187 attached to the soft foam lining 186. The hard foam lining 187 is configured to hold the intake valve panel 120 at a distance from the user's face (not shown), thereby allowing the intake valves 123A-123D to open and close freely. Preferably, but not necessarily, and as depicted, the hard foam lining 187 surrounds the soft foam lining 186. The hard foam lining 187 is attached to the base 108 on an opposite side of the hard foam lining 187 from where the hard foam lining 187 attaches to the soft foam lining 186. For example, the hard foam lining 187 is attached to the mask base 108 using one or more of tape and glue. For example, the hard foam lining 187 is attached to the soft foam lining 186 using one or more of tape and glue.

For example, the soft foam lining 186 comprises hypoallergenic foam. For example, the soft foam lining 186 comprises latex-free foam. For example, the soft foam lining 186 comprises latex-free, hypoallergenic foam. For example, the hard foam lining 187 comprises hypoallergenic foam. For example, the hard foam lining 187 comprises latex-free foam. For example, the hard foam lining 187 comprises latex-free, hypoallergenic foam.

FIG. 1B is a drawing showing an assembled interior view of the dual filtration COVID-19 mask 100. The mask 100 again comprises the mask left side 105A, the mask right side 105B (the "left side" and "right side" descriptors are as seen in the interior view shown in FIGS. 1A and 1*n* this figure), and the mask center 107.

The mask 100 again further comprises the mask base 108. The mask base 108 again comprises the intake valve panel 120. The intake valve panel 120 again comprises the one or more intake valve assemblies 122A-122D.

At least one of the intake valve assemblies 122A-122D again comprises a respective intake valve 123A-123D, at least one of the one or more intake valves 123A-123D again configured to open to transmit the user's intake breath. Preferably, but not necessarily, and as depicted, each of the one or more intake valves 123A-123D again is configured to open to transmit the user's intake breath. The intake valves 123A-123D are closed because the user again is not currently breathing an intake breath.

The intake valve panel 120 again further comprises one or more base intake holes 127A-127D, wherein at least one of the base intake holes 127A-127D again is configured snugly to hold a corresponding intake valve 123A-123D while allowing the user's intake breath to pass from the outside 128 of the mask 100 to the inside 101 of the mask 100. Preferably, but not necessarily, and as depicted, each of the base intake holes 127A-127D is configured to snugly hold the corresponding intake valve 123A-123D while allowing the user's intake breath to pass from the outside 128 of the mask 100 to the inside 101 of the mask 100.

The intake valves 123A-123D again are attached to the corresponding intake valve bases 124A-124D by corresponding intake valve hinges 126A-126D.

The mask base 108 again further comprises the left exhaust valve assembly 131A and the right exhaust valve assembly 131B.

The left exhaust valve assembly 131A again comprises the left exhaust valve 138A. The right exhaust valve assembly again comprises the right exhaust valve 138B. One or more of the left exhaust valve 138A and the right exhaust valve 138B again are configured to open to transmit the user's exhale breath. Preferably, but not necessarily, and as depicted, both the left exhaust valve 138A and the right exhaust valve 138B again are configured to open to transmit the user's exhale breath. At least one of the one or more exhaust valves 138A-138B again is configured to close promptly after transmission of the user's exhale breath. One or more of the left exhaust valve 138A and the right exhaust valve 138B again are configured to close promptly after transmission of the user's exhale breath. Preferably, but not necessarily, and as depicted, each of the exhaust valves 138A-138B again is configured to close promptly after transmission of the user's exhale breath. The left exhaust valve 138A and the right exhaust valve 138B are closed because the user is not currently breathing an exhale breath. The exhaust valves 138A-138B again are positioned at the respective exhaust-intake distances 139A-139B from the intake valve panel 120.

The left exhaust valve assembly 131A again further comprises the left exhaust valve base 140A and the left exhaust tube 145A. The right exhaust valve assembly 131B again comprises the right exhaust valve base 140B and the right exhaust tube 145B.

The left exhaust tube 145A again comprises the left exhaust tube inner diameter 146A, the right exhaust tube inner diameter 146B, the left exhaust tube outer diameter 147A, and the right exhaust tube outer diameter 147B. Preferably, but not necessarily, and as depicted, the left exhaust valve diameter 143A again is roughly equal to and very slightly less than the left exhaust tube inner diameter 146A so that the left exhaust valve 138A fits snugly inside the left exhaust tube 145A. Accordingly, the left exhaust tube 145A again allows the left exhaust valve 138A to open and close freely while holding the left exhaust valve 138A tightly. Preferably, but not necessarily, and as depicted, the right exhaust valve diameter 143B again is roughly equal to and very slightly less than the right exhaust tube inner diameter 146B so that the right exhaust valve 138B fits snugly inside the right exhaust tube 145B. Accordingly, the right exhaust tube 145B again allows the right exhaust valve 138B to open and close freely while holding the right exhaust valve 138B tightly.

The left exhaust tube 145A again further comprises the left exhaust filter 150A the left exhaust filter 150A again configured to filter a first portion of the user's exhale breath through the right exhaust tube 145B. The right exhaust tube 145B again further comprises the right exhaust filter 150B the right exhaust filter 150B again configured to filter a second portion of the user's exhale breath through the right exhaust tube 145B.

The left exhaust tube 145A again further comprises the left exhaust tube exhaust end 151A that is close to the left exhaust valve 138A. The right exhaust tube 145B again further comprises the right exhaust tube exhaust end 151B that is close to the right exhaust valve 138B. The left exhaust tube exhaust end 151A is again located at the left valve to end distance 152A from the left exhaust valve 138A. The right exhaust tube exhaust end 151B is again located at the right valve to end distance 152B from the right exhaust valve 138B.

The left exhaust filter 150A again is attached to the left exhaust tube 145A near the left exhaust tube exhaust end 151A. The right exhaust filter 150B again is attached to the right exhaust tube 145A near the right exhaust tube exhaust end 151B.

The left exhaust tube 145A again further comprises the left exhaust tube base end 153A that is close to the mask base 108. The right exhaust tube 145B again further comprises the right exhaust tube base end 153B that is close to the mask base 108.

Preferably, but not necessarily, and as depicted, the left exhaust filter 150A again comprises the left exhaust filter fastener 155A configured to fasten the left exhaust filter 150A onto the left exhaust tube 145A. Preferably, but not necessarily, and as depicted, the right exhaust filter 150B again comprises the right exhaust filter fastener 155B configured to fasten the right exhaust filter 150B onto the right exhaust tube 145B.

The mask 100 again further comprises the mask cover 178, the mask cover 178 again configured to cover the outside 128 of the mask 100. The mask cover 178 is again attached to the mask base 108.

The mask cover 178 again comprises one or more of the left strap 179A and the right strap 179B. Preferably, but not necessarily, and as depicted, the mask cover 178 again comprises both the left strap 179A and the right strap 179B. The left strap 179A again comprises the left strap connector 180A. The right strap 179B again comprises the right strap connector 180B. The left strap connector 180A and the right strap connector 180B again are connectable to hold the mask 100 on the user's face (not shown).

The mask cover 178 again further comprises the intake filter 181, which again is configured to filter the user's intake breath through the intake valve panel 120.

The mask cover 178 again further comprises the intake hole 183, which is again configured to allow the user's intake breath to pass from the outside 128 of the mask 100 to the intake valve panel 120 and then through the intake filters 123A-123D to the inside 101 of the mask 100.

The mask 100 again further comprises the soft foam lining 186, which is again configured to comfortably hold the mask 100 against the user's face (not shown).

The mask 100 again further comprises the hard foam lining 187, which again is attached to the soft foam lining 186. The hard foam lining 187 again is configured to hold the intake valve panel 120 at a distance from the user's face (not shown), thereby allowing the intake valves 123A-123D to open and close freely. Preferably, but not necessarily, and as depicted, the hard foam lining 187 again surrounds the soft foam lining 186. The hard foam lining 187 is again attached to the base 108.

Components of the mask 100 that are not visible in FIG. 1B include the intake valve bases (items 124A-124D in FIG. 1A), the base intake holes (items 125A-125D in FIG. 1A), the intake valve hinges (items 126A-126D in FIGS. 1A, 2B, 2D, 3B, 4B, 5F, and 5H), the left exhaust valve hinge (item 142A in FIGS. 1A, 1B, 2C, 3C, 4C, and 5E-5H), the right exhaust valve hinge (item 142B in FIGS. 1A, 1B, 2C, 3C, 4C, and 5E-5H), the left exhaust valve diameter and the right exhaust valve diameter (items 143A and 143B in FIG. 1A), the left base exhaust hole (item 158A in FIGS. 1A, 1B, 2A, 2C, 3A, 3C, 4A, 4C, and 5E-5H), the right base exhaust hole (item 158B in FIGS. 1A, 1B, 2A, 3A, 4A, and 5E-5H), the left base anchor and the right base anchor (items 159A-159B in FIG. 1A), the intake filter slot (item 182 in FIGS. 1A, 2B, 3B, and 4B), and the left cover exhaust hole and the right cover exhaust hole (items 184A and 184B in FIG. 1A).

FIG. 1C is a drawing showing an assembled exterior view of the dual filtration COVID-19 mask 100. The mask 100 again comprises the mask left side 105A, the mask right side 105B (the "left side" and "right side" descriptors are as seen in the interior view shown in FIGS. 1A-1B), and the mask center 107.

The mask base 108 again further comprises the left exhaust valve assembly 131A and the right exhaust valve assembly 131B.

The left exhaust valve assembly 131A again further comprises the left exhaust filter 150A. The right exhaust valve assembly 131B again further comprises the right exhaust filter 150B.

The left exhaust valve assembly 131A again further comprises the left exhaust filter 150A and the right exhaust filter 150B. Preferably, but not necessarily, and as depicted, the left exhaust filter 150A again comprises the left exhaust filter fastener 155A. Preferably, but not necessarily, and as depicted, the right exhaust filter 150B again comprises the right exhaust filter fastener 155B.

The mask 100 again further comprises the mask cover 178, the mask cover 178 again configured to cover the outside 128 of the mask 100. The mask cover 178 again comprises one or more of the left strap 179A and the right strap 179B. Preferably, but not necessarily, and as depicted, the mask cover 178 again comprises both the left strap 179A and the right strap 179B. The left strap 179A again comprises the left strap connector 180A. The right strap 179B again comprises the right strap connector 180B. The left strap connector 180A and the right strap connector 180B again are connectable to hold the mask 100 on the user's face (not shown).

The mask cover 178 again further comprises the intake filter 181.

The mask 100 again further comprises the soft foam lining 186, which is again configured to comfortably hold the mask 100 against the user's face (not shown).

The mask 100 again further comprises the hard foam lining 187, which again is attached to the soft foam lining 186. Preferably, but not necessarily, and as depicted, the hard foam lining 187 again surrounds the soft foam lining 186. The hard foam lining 187 is again attached to the base 108.

Components of the mask 100 that are not visible in FIG. 1C include the mask base (item 108 in all other figures) the intake valve panel (item 120 in FIGS. 1A, 1B, 2A, 2B, 2D, 3A, 3B, 4A, and 4B), the intake valve assemblies (items 122A-122D in FIGS. 1A, 1B, 2A, 2B, 2D, 3A, 3B, 4A, 4B, and 5E-5H), the intake valves (items 123A-123D in FIGS. 1A, 1B, 2A, 2B, 2D, 3A, 3B, 4A, 4B, and 5E-5H), the intake valve bases (items 124A-124D in FIG. 1A), the base intake holes (items 125A-125D in FIG. 1A), the intake valve hinges (items 126A-126D in FIGS. 1A, 2B, 2D, 3B, 4B, 5F, and 5H), the base intake holes (items 127A-127D in FIGS. 1A, 1B, 2A, 3A, 4A, and 5B-5H), the left exhaust valve (item 138A in FIGS. 1A, 1B, 2A, 2C, 3A, 3C, 4A, 4C, and 5E-5H), the right exhaust valve (item 138B in FIGS. 1A, 1B, 2A, 3A, 4A, and 5E-5H), the left exhaust valve base (item 140A in FIGS. 1A, 1B, 2A, 2C, 3A, 3C, 4A, 4C, and 5E-5H), the right exhaust valve base (item 140B in FIGS. 1A, 1B, 2A, 3A, 4A, and 5E-5H), the left exhaust valve base hole (item 141A in FIG. 1A), the right exhaust valve base hole (item 141B in FIG. 1A), the left exhaust valve hinge (item 142A in FIGS. 1A, 1B, 2C, 3C, 4C, and 5E-5H), the right exhaust valve hinge (item 142B in FIGS. 1A, 1B, 2C, 3C, 4C, and 5E-5H), the left exhaust valve diameter and the right exhaust valve diameter (items 143A and 143B in FIG. 1A), the left exhaust tube (item 145A in FIGS. 1A, 1B, 2A, 2C, 3A, 3C, 4A, 4C, and 5E-5H), the right exhaust tube (item 145B in FIGS. 1A, 1B, 2A, 3A, 4A, and 5E-5H), the left exhaust tube inner diameter and the right exhaust tube inner diameter (items 146A and 146B in FIGS. 1A and 1B), the left exhaust tube outer diameter and the right exhaust tube outer diameter (items 147A and 147B in FIGS. 1A and 1B), the left exhaust tube exhaust end (item 151A in FIGS. 1A, 1B, 2A, 2C, 3A, 3C, 4A, 4C, and 5E-5H), the right exhaust tube exhaust end (item 151B in FIGS. 1A, 1B, 2A, 3A, 4A, and 5E-5H), the left valve to end distance and the right valve to end distance (items 152A and 152B in FIGS. 1A and 1B), the left exhaust tube base end (item 153A in FIGS. 1A, 1B, 2A, 2C, 3A, 3C, 4A, 4C, and 5E-5H), the right exhaust tube base end (item 153B in FIGS. 1A, 1B, 2A, 3A, 4A, and 5E-5H), the left base exhaust hole (item 158A in FIGS. 1A, 1B, 2A, 2C, 3A, 3C, 4A, 4C, and 5E-5H), the right base exhaust hole (item 158B in FIGS. 1A, 1B, 2A, 3A, 4A, and 5E-5H), the left base anchor and the right base anchor (items 159A-159B in FIG. 1A), the intake filter slot (item 182 in FIGS. 1A, 2B, 3B, and 4B), the intake hole (item 183 in FIGS. 1A and 1B), the left cover exhaust hole and the right cover exhaust hole (items 184A and 184B in FIG. 1A), the soft foam lining (item 186 in FIGS. 1A, 1B, 2A, 3A, and 4A) and the hard foam lining (item 187 in FIGS. 1A, 1B, 2A, 3A, and 4A).

Figure 2A:
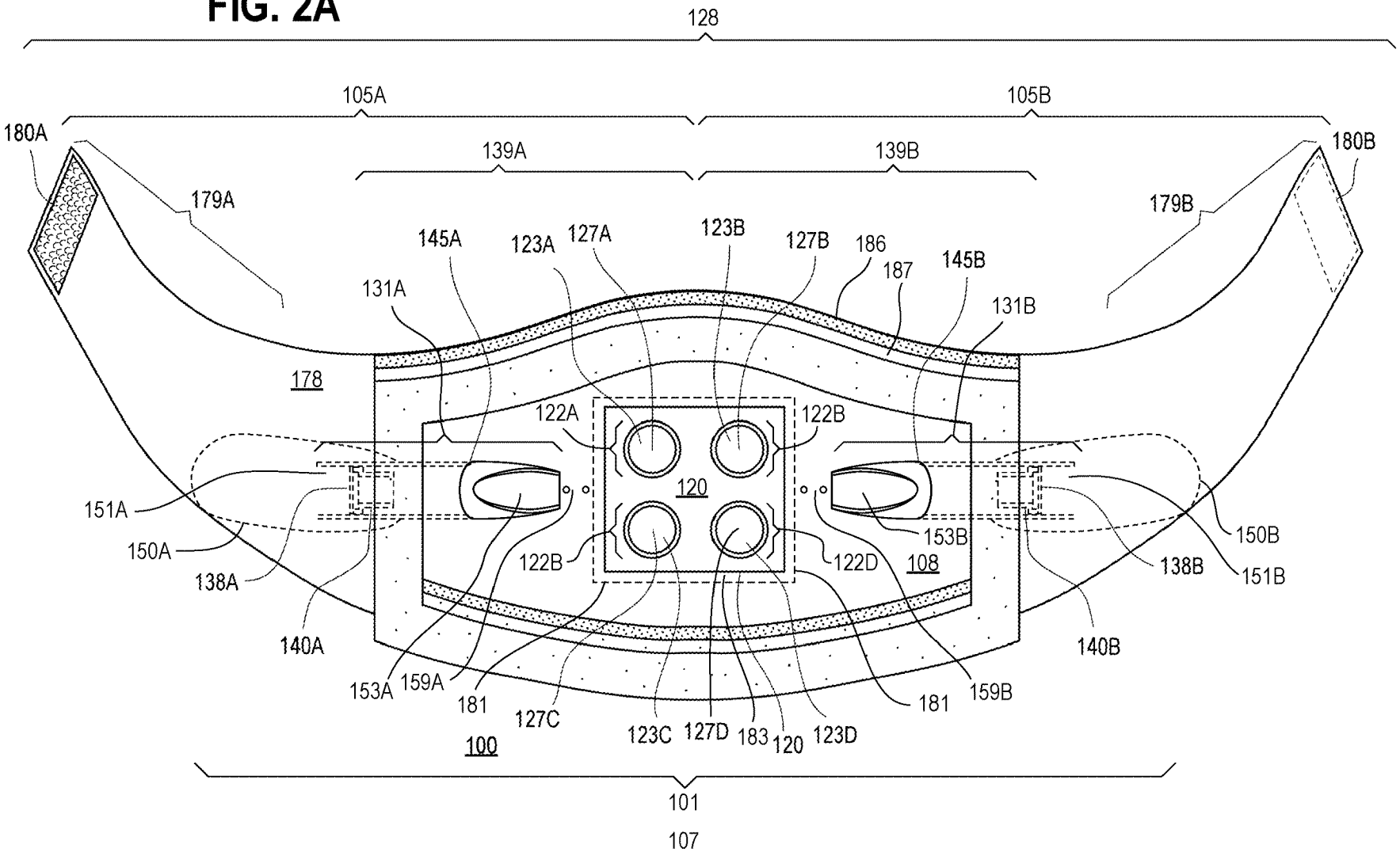
FIGS. 2A-2C are a set of three drawings of a dual filtration COVID-19 mask configured to allow a user to breathe, showing the mask prior to use.
Figure 2B:
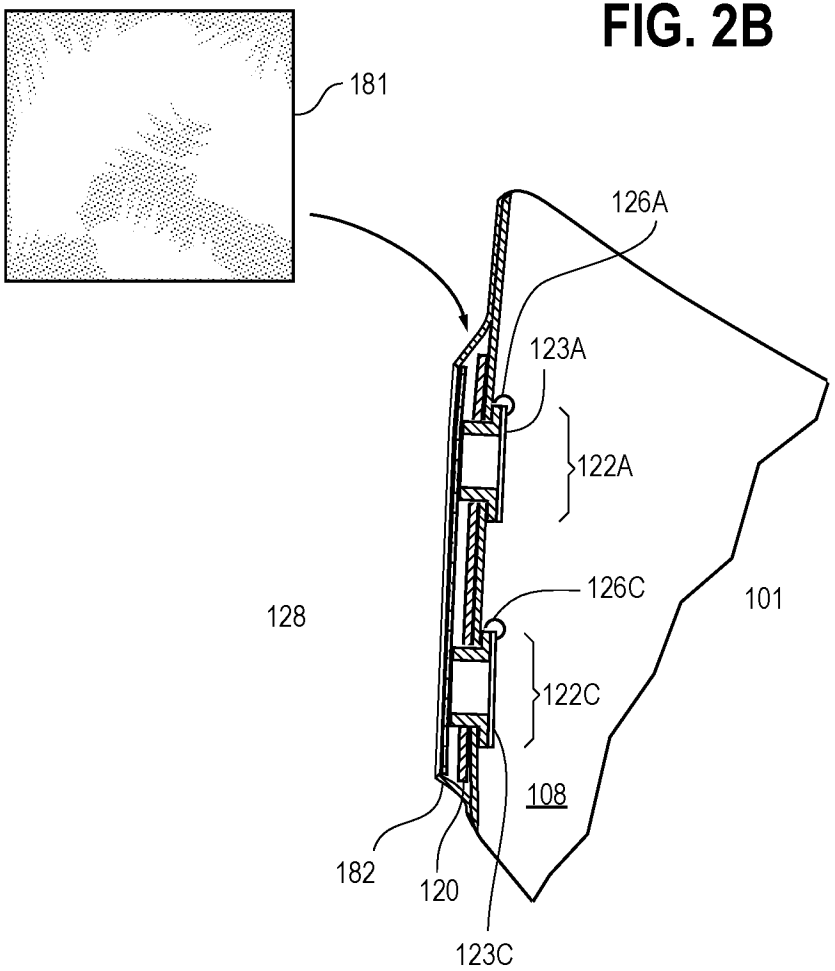
Figure 2C:
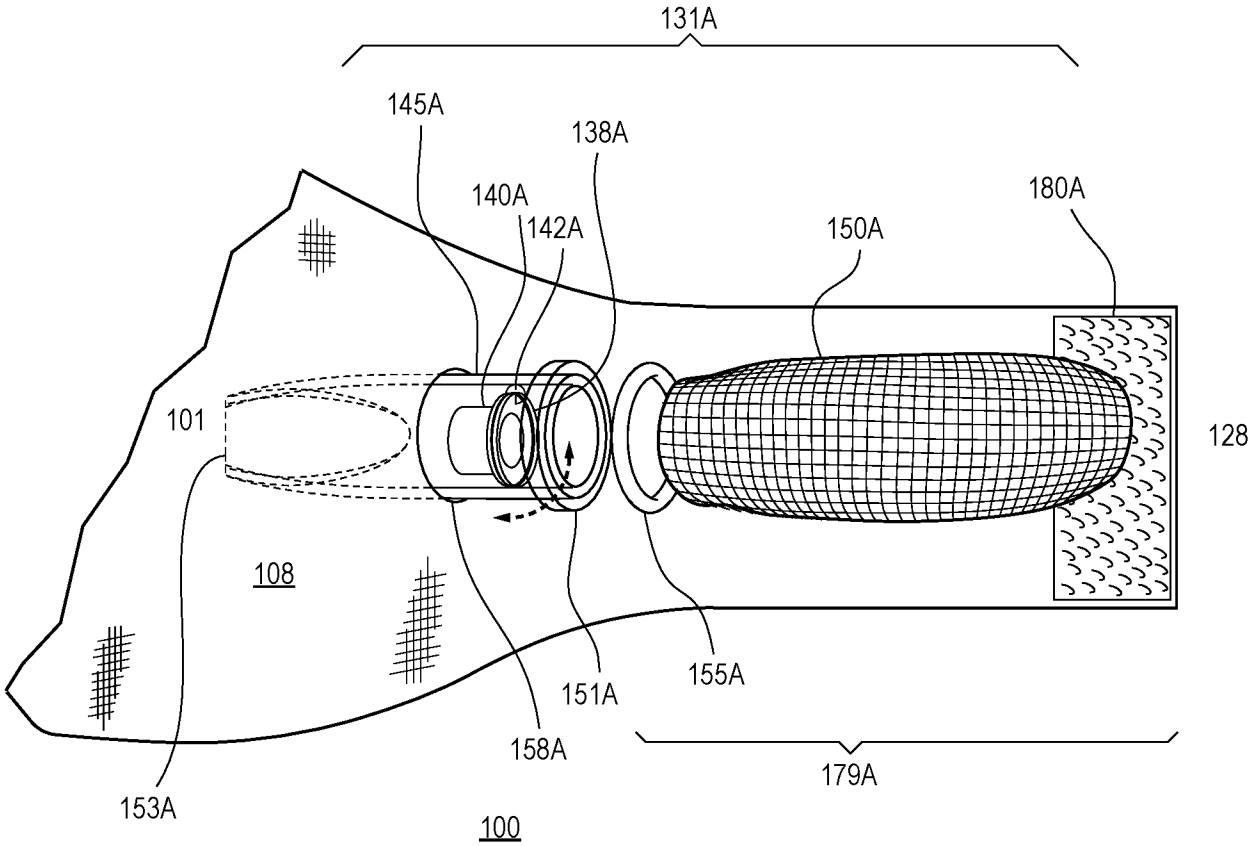

FIGS. 2A-2C are a set of three drawings of a dual filtration COVID-19 mask 100 configured to allow a user to breathe, showing the mask 100 prior to use. FIGS. 2A-2C show the mask 100 as it appears following the user's exhale breath and prior to the user's intake breath.

FIG. 2A is a drawing showing an interior view of the dual filtration COVID-19 mask 100 as seen from an inside 101 of the mask 100. The mask 100 is configured to allow the user (not shown) to breathe, showing the mask 100 prior to use. FIG. 2A depicts the mask 100 as it appears following the user's exhale breath and prior to the user's next intake breath. The mask 100 (the "left side" and "right side" descriptors are as seen in the interior view shown in FIGS. 1A-1B and in this figure) again comprises the mask left side 105A, the mask right side 105B, and the mask center 107.

The mask 100 again further comprises the mask base 108. The mask base 108 again comprises the intake valve panel 120. The intake valve panel 120 again comprises the one or more intake valve assemblies 122A-122D.

At least one of the intake valve assemblies 122A-122D again comprises a respective intake valve 123A-123D, at least one of the one or more intake valves 123A-123D again configured to open to transmit the user's intake breath. Preferably, but not necessarily, and as depicted, each of the one or more intake valves 123A-123D is again configured to open to transmit the user's intake breath. The intake valves 123A-123D are closed because the user is not currently breathing an intake breath.

The intake valve panel 120 again further comprises one or more base intake holes 127A-127D, wherein at least one of the base intake holes 127A-127D again is configured snugly to hold a corresponding intake valve 123A-123D while allowing the user's intake breath to pass from the outside 128 of the mask 100 to the inside 101 of the mask 100. Preferably, but not necessarily, and as depicted, each of the base intake holes 127A-127D is configured to snugly hold the corresponding intake valve 123A-123D while allowing the user's intake breath to pass from the outside 128 of the mask 100 to the inside 101 of the mask 100.

The mask base 108 again further comprises the left exhaust valve assembly 131A and the right exhaust valve assembly 131B the left base anchor 159A, and the right base anchor 159B.

The left exhaust valve assembly 131A again comprises the left exhaust valve 138A. The right exhaust valve assembly again comprises the right exhaust valve 138B. One or more of the left exhaust valve 138A and the right exhaust valve 138B again are configured to open to transmit the user's exhale breath. Preferably, but not necessarily, and as depicted, both the left exhaust valve 138A and the right exhaust valve 138B again are configured to open to transmit the user's exhale breath. At least one of the one or more exhaust valves 138A-138B again is configured to close promptly after transmission of the user's exhale breath. One or more of the left exhaust valve 138A and the right exhaust valve 138B again are configured to close promptly after transmission of the user's exhale breath. Preferably, but not necessarily, and as depicted, each of the exhaust valves 138A-138B again is configured to close promptly after transmission of the user's exhale breath. The left exhaust valve 138A and the right exhaust valve 138B are closed because the user is not currently breathing an exhale breath. The exhaust valves 138A-138B again are positioned at the respective exhaust-intake distances 139A-139B from the intake valve panel 120.

The left exhaust valve assembly 131A again further comprises the left exhaust valve base 140A and the left exhaust tube 145A. The right exhaust valve assembly 131B again comprises the right exhaust valve base 140B and the right exhaust tube 145B.

The left exhaust tube 145A again further comprises the left exhaust filter 150A the left exhaust filter 150A again configured to filter a first portion of the user's exhale breath through the right exhaust tube 145B. The right exhaust tube 145B again further comprises the right exhaust filter 150B the right exhaust filter 150B again configured to filter e second portion of the user's exhale breath through the right exhaust tube 145B.

The left exhaust tube 145A again further comprises the left exhaust tube exhaust end 151A that is close to the left exhaust valve 138A. The right exhaust tube 145B again further comprises the right exhaust tube exhaust end 151B that is close to the right exhaust valve 138B.

The left exhaust filter 150A again is attached to the left exhaust tube 145A near the left exhaust tube exhaust end 151A. The right exhaust filter 150B again is attached to the right exhaust tube 145A near the right exhaust tube exhaust end 151B.

The left exhaust tube 145A again further comprises the left exhaust tube base end 153A that is close to the mask base 108. The right exhaust tube 145B again further comprises the right exhaust tube base end 153B that is close to the mask base 108.

Preferably, but not necessarily, and as depicted, the left exhaust filter 150A again comprises the left exhaust filter fastener 155A configured to fasten the left exhaust filter 150A onto the left exhaust tube 145A. Preferably, but not necessarily, and as depicted, the right exhaust filter 150B again comprises the right exhaust filter fastener 155B configured to fasten the right exhaust filter 150B onto the right exhaust tube 145B.

The mask 100 again further comprises the mask cover 178, the mask cover 178 again configured to cover the outside 128 of the mask 100. The mask cover 178 is again attached to the mask base 108.

The mask cover 178 again comprises one or more of the left strap 179A and the right strap 179B. Preferably, but not necessarily, and as depicted, the mask cover 178 again comprises both the left strap 179A and the right strap 179B. The left strap 179A again comprises the left strap connector 180A. The right strap 179B again comprises the right strap connector 180B. The left strap connector 180A and the right strap connector 180B again are connectable to hold the mask 100 on the user's face (not shown).

The mask cover 178 again further comprises the intake filter 181, which again is configured to filter the user's intake breath through the intake valve panel 120.

The mask cover 178 again further comprises the intake hole 183, which is again configured to allow the user's intake breath to pass from the outside 128 of the mask 100 to the intake valve panel 120 and then through the intake filters 123A-123D to the inside 101 of the mask 100.

The mask 100 again further comprises the soft foam lining 186, which is again configured to comfortably hold the mask 100 against the user's face (not shown).

The mask 100 again further comprises the hard foam lining 187, which again is attached to the soft foam lining 186. The hard foam lining 187 again is configured to hold the intake valve panel 120 at a distance from the user's face (not shown), thereby allowing the intake valves 123A-123D to open and close freely. Preferably, but not necessarily, and as depicted, the hard foam lining 187 again surrounds the soft foam lining 186. The hard foam lining 187 is again attached to the base 108.

Components of the mask 100 that are not visible in FIG. 2A include the intake valve bases (items 124A-124D in FIG. 1A), the base intake holes (items 125A-125D in FIG. 1A), the intake valve hinges (items 126A-126D in FIGS. 1A, 2B, 2D, 3B, 4B, 5F, and 5H), the left exhaust valve hinge (item 142A in FIGS. 1A, 1B, 2C, 3C, 4C, and 5E-5H), the right exhaust valve hinge (item 142B in FIGS. 1A, 1B, 2C, 3C, 4C, and 5E-5H), the left exhaust valve diameter and the right exhaust valve diameter (items 143A and 143B in FIG. 1A), the left exhaust tube and the right exhaust tube (items 145A and 145B in FIGS. 1A, 1B, 2C, 3C, 4C, and 5F-5H), the left exhaust tube inner diameter and the right exhaust tube inner diameter (items 146A and 146B in FIGS. 1A and 1B), the left exhaust tube outer diameter and the right exhaust tube outer diameter (items 147A and 147B in FIGS. 1A and 1B), the left valve to end distance and the right valve to end distance (items 152A and 152B in FIGS. 1A and 1B), the left exhaust filter fastener (item 155A in FIGS. 1A, 1B, 2B, 3B, and 4B), the right exhaust filter fastener (item 155B in FIGS. 1A and 1B; also not shown in FIGS. 2B, 3B, and 4B), the left base exhaust hole and the right base exhaust hole (items 158A-158B in FIGS. 1A, 2C, 3C, 4C, and 5B-5H), the intake filter slot (item 182 in FIGS. 1A, 2B, 3B, and 4B), the intake hole (item 183 in FIGS. 1A and 1B), and the left cover exhaust hole and the right cover exhaust hole (items 184A and 184B in FIG. 1A).

FIG. 2B is a drawing showing a left side cross section view of a front portion of the mask 100 configured to allow the user (not shown) to breathe, showing the mask 100 prior to use. FIG. 2B also depicts the mask 100 as it appears following the user's exhale breath and prior to the user's next intake breath.

The mask 100 again comprises the mask base 108. The mask base 108 again comprises the intake valve panel 120. The intake valve panel 120 again comprises the one or more intake valve assemblies 122A-122D.

At least one of the intake valve assemblies 122A-122D again comprises a respective intake valve 123A-123D, at least one of the one or more intake valves 123A-123D again configured to open to transmit the user's intake breath from the outside 128 of the mask 100 to the inside 101 of the mask 100. Preferably, but not necessarily, and as depicted, each of the one or more intake valves 123A-123D again is configured to open to transmit the user's intake breath. The intake valves 123A-123D are closed because the user is not currently breathing an intake breath. The intake valves 123A-123D again are attached to the corresponding intake valve bases 124A-124D by corresponding intake valve hinges 126A-126D.

The intake valves 123A-123D again are attached to the corresponding intake valve bases 124A-124D by corresponding intake valve hinges 126A-126D.

The mask base 108 again further comprises the left exhaust valve assembly 131A and the right exhaust valve assembly 131B.

The mask cover 178 again further comprises the intake filter 181, which again is configured to filter the user's intake breath through the intake valve panel 120.

The mask 100 again further comprises the soft foam lining 186, which is again configured to comfortably hold the mask 100 against the user's face (not shown).

The mask 100 again further comprises the hard foam lining 187, which again is attached to the soft foam lining 186. The hard foam lining 187 again is configured to hold the intake valve panel 120 at a distance from the user's face (not shown), thereby allowing the intake valves 123A-123D to open and close freely. Preferably, but not necessarily, and as depicted, the hard foam lining 187 again surrounds the soft foam lining 186. The hard foam lining 187 is again attached to the base 108.

The mask 100 further comprises an intake filter slot 182 configured to receive the intake filter 181, the intake filter slot 182 further configured to hold the intake filter 181 firmly in place.

Components of the mask 100 that are not visible in FIG. 2B include the mask left side and the mask right side (items 105A-105B in FIGS. 1A-1C, 2A, 3A, and 4A), the mask center (item 107 in FIGS. 1A-1C, 2A, 2C, 2D, 3A, 3C, 4A, and 5F-5H), the intake valve bases (items 124A-124D in FIG. 1A), the base intake holes (items 125A-125D in FIG. 1A), the base intake holes (items 127A-127D in FIGS. 1A, 1B, 2A, 3A, 4A, and 5B-5H), the left exhaust valve assembly (item 131A in FIGS. 1A, 1B, 2A, 2C, 3A, 3C, 4A, 4C, and 5E-5H), the right exhaust valve assembly (item 131B in FIGS. 1A, 1B, 2A, 3A, 4A, and 5E-5H), the left exhaust valve (item 138A in FIGS. 1A, 1B, 2A, 2C, 3A, 3C, 4A, 4C, and 5E-5H), the right exhaust valve (item 138B in FIGS. 1A, 1B, 2A, 3A, 4A, and 5E-5H), the left exhaust valve base (item 140A in FIGS. 1A, 1B, 2A, 2C, 3A, 3C, 4A, 4C, and 5E-5H), the right exhaust valve base (item 140B in FIGS. 1A, 1B, 2A, 3A, 4A, and 5E-5H), the left exhaust valve base hole (item 141A in FIG. 1A), the right exhaust valve base hole (item 141B in FIG. 1A), the left exhaust valve hinge (item 142A in FIGS. 1A, 1B, 2C, 3C, 4C, and 5E-5H), the right exhaust valve hinge (item 142B in FIGS. 1A, 1B, 2C, 3C, 4C, and 5E-5H), the left exhaust valve diameter and the right exhaust valve diameter (items 143A and 143B in FIG. 1A), the left exhaust tube (item 145A in FIGS. 1A, 1B, 2A, 2C, 3A, 3C, 4A, 4C, and 5E-5H), the right exhaust tube (item 145B in FIGS. 1A, 1B, 2A, 3A, 4A, and 5E-5H), the left exhaust tube inner diameter and the right exhaust tube inner diameter (items 146A and 146B in FIGS. 1A and 1B), the left exhaust tube outer diameter and the right exhaust tube outer diameter (items 147A and 147B in FIGS. 1A and 1B), the left exhaust filter (item 150A in FIGS. 1A, 1B, 2A, 2C, 3A, 3C, 4A, 4C, and 5E-5H), the right exhaust filter (item 150B in FIGS. 1A, 1B, 2A, 3A, 4A, and 5E-5H), the left exhaust tube exhaust end (item 151A in FIGS. 1A, 1B, 2A, 2C, 3A, 3C, 4A, 4C, and 5E-5H), the right exhaust tube exhaust end (item 151B in FIGS. 1A, 1B, 2A, 3A, 4A, and 5E-5H), the left valve to end distance and the right valve to end distance (items 152A and 152B in FIGS. 1A and 1B), the left exhaust tube base end (item 153A in FIGS. 1A, 1B, 2A, 2C, 3A, 3C, 4A, 4C, and 5E-5H), the right exhaust tube base end (item 153B in FIGS. 1A, 1B, 2A, 3A, 4A, and 5E-5H), the left exhaust filter fastener (item 155A in FIGS. 1A, 1B, 2A, 2C, 3A, 3C, 4A, 4C, and 5E-5H), the right exhaust filter fastener (item 155B in FIGS. 1A, 1B, 2A, 3A, 4A, and 5E-5H), the left base exhaust hole (item 158A in FIGS. 1A, 1B, 2A, 2C, 3A, 3C, 4A, 4C, and 5E-5H), the right base exhaust hole (item 158B in FIGS. 1A, 1B, 2A, 3A, 4A, and 5E-5H), the left base anchor and the right base anchor (items 159A-159B in FIG. 1A), the mask cover (item 178 in FIGS. 1A-1C, 2A, 3A, and 4A), the left strap (item 179A in FIGS. 1A-1C, 2A, 2C, 2D, 3A, 3C, 4A, and 4C), the right strap (item 179B in FIGS. 1A-1C, 2A, 3A, and 4A), the left strap connector (item 180A in FIGS. 1A-1C, 2A, 2C, 2D, 3A, 3C, 4A, and 4C), the right strap connector (item 180B in FIGS. 1A-1C, 2A, 3A, and 4A), the intake hole (item 183 in FIGS. 1A and 1B), and the left cover exhaust hole and the right cover exhaust hole (items 184A and 184B in FIG. 1A).

FIG. 2C is a drawing showing an interior view of a left portion of the mask 100 configured to allow the user (not shown) to breathe, showing the mask 100 prior to use.

The mask 100 again further comprises the mask base 108.

The mask base 108 again comprises the left exhaust valve assembly 131A. The left exhaust valve assembly 131A again comprises the left exhaust valve 138A. The left exhaust valve 138A again is configured to open to transmit the user's exhale breath. The left exhaust valve 138A again is configured to close promptly after transmission of the user's exhale breath. The left exhaust valve 138A is closed because the user is not currently breathing an exhale breath.

The left exhaust valve assembly 131A again further comprises the left exhaust valve base 140A, the left exhaust valve hinge 142A, and the left exhaust tube 145A.

The left exhaust tube 145A again further comprises the left exhaust filter 150A.

The left exhaust tube 145A again further comprises the left exhaust tube exhaust end 151A that is close to the left exhaust valve 138A. The left exhaust tube exhaust end 151A is again located at the left valve to end distance 152A from the left exhaust valve 138A.

The left exhaust filter 150A again is attached to the left exhaust tube 145A near the left exhaust tube exhaust end 151A.

The left exhaust tube 145A again further comprises the left exhaust tube base end 153A that is close to the mask base 108.

Preferably, but not necessarily, and as depicted, the left exhaust filter 150A again comprises the left exhaust filter fastener 155A configured to fasten the left exhaust filter 150A onto the left exhaust tube 145A.

The mask 100 again further comprises the mask cover 178, the mask cover 178 again configured to cover the outside 128 of the mask 100. The mask cover 178 is again attached to the mask base 108.

The mask cover 178 again comprises the left strap 179A. The left strap 179A again comprises the left strap connector 180A.

Components of the mask 100 that are not visible in FIG. 2C include the mask base (item 108 in all other figures) the intake valve panel (item 120 in FIGS. 1A, 1B, 2A, 2B, 2D, 3A, 3B, 4A, and 4B), the intake valve assemblies (items 122A-122D in FIGS. 1A, 1B, 2A, 2B, 2D, 3A, 3B, 4A, 4B, and 5E-5H), the intake valves (items 123A-123D in FIGS. 1A, 1B, 2A, 2B, 2D, 3A, 3B, 4A, 4B, and 5E-5H), the intake valve bases (items 124A-124D in FIG. 1A), the base intake holes (items 125A-125D in FIG. 1A), the intake valve hinges (items 126A-126D in FIGS. 1A, 2B, 2D, 3B, 4B, 5F, and 5H), the base intake holes (items 127A-127D in FIGS. 1A, 1B, 2A, 3A, 4A, and 5B-5H), the right exhaust valve assembly (item 131B in 1A, 1B, 2A, 3A, 4A, and 5E-5H), the right exhaust valve (item 138B in FIGS. 1A, 1B, 2A, 3A, 4A, and 5E-5H), the left exhaust valve base (item 140A in FIGS. 1A, 1B, 2A, 2C, 3A, 3C, 4A, 4C, and 5E-5H), the right exhaust valve base (item 140B in FIGS. 1A, 1B, 2A, 3A, 4A, and 5E-5H), the left exhaust valve base hole (item 141A in FIG. 1A), the right exhaust valve base hole (item 141B in FIG. 1A), the left exhaust valve base hole (item 141A in FIG. 1A), the right exhaust valve base hole (item 141B in FIG. 1A), the right exhaust valve hinge (item 142B in FIGS. 1A, 1B, 2A, 3A, 4A, and 5E-5H), the left exhaust valve diameter and the right exhaust valve diameter (items 143A and 143B in FIG. 1A), the right exhaust tube (item 145B in FIGS. 1A, 1B, 2A, 3A, 4A, and 5E-5H), the left exhaust tube inner diameter and the right exhaust tube inner diameter (items 146A and 146B in FIGS. 1A and 1B), the left exhaust tube outer diameter and the right exhaust tube outer diameter (items 147A and 147B in FIGS. 1A and 1B), the right exhaust filter (item 150B in FIGS. 1A, 1B, 2A, 3A, 4A, and 5E-5H), the right exhaust tube exhaust end (item 151B in FIGS. 1A, 1B, 2A, 3A, 4A, and 5E-5H), the left valve to end distance and the right valve to end distance (items 152A and 152B in FIGS. 1A and 1B), the right exhaust tube base end (item 153B in FIGS. 1A, 1B, 2A, 3A, 4A, and 5E-5H), the right exhaust filter fastener (item 155B in FIGS. 1A, 1B, 2A, 3A, 4A, and 5E-5H), the right base exhaust hole (item 158B in FIGS. 1A, 1B, 2A, 3A, 4A, and 5E-5H), the left base anchor and the right base anchor (items 159A-159B in FIG. 1A), the right strap (item 179B in FIGS. 1A-1C, 2A, 3A, and 4A), the right strap connector (item 180B in FIGS. 1A-1C, 2A, 3A, and 4A), the intake filter (item 181 in FIGS. 1A, 1B, 1C, 2A, 2B, 3A, 3B, 4A, and 4B). the intake filter slot (item 182 in FIGS. 1A, 2B, 3B, and 4B), the intake hole (item 183 in FIGS. 1A and 1B), the left cover exhaust hole and the right cover exhaust hole (items 184A and 184B in FIG. 1A), the soft foam lining (item 186 in FIGS. 1A, 1B, 2A, 3A, and 4A) and the hard foam lining (item 187 in FIGS. 1A, 1B, 2A, 3A, and 4A).

Figure 3A:
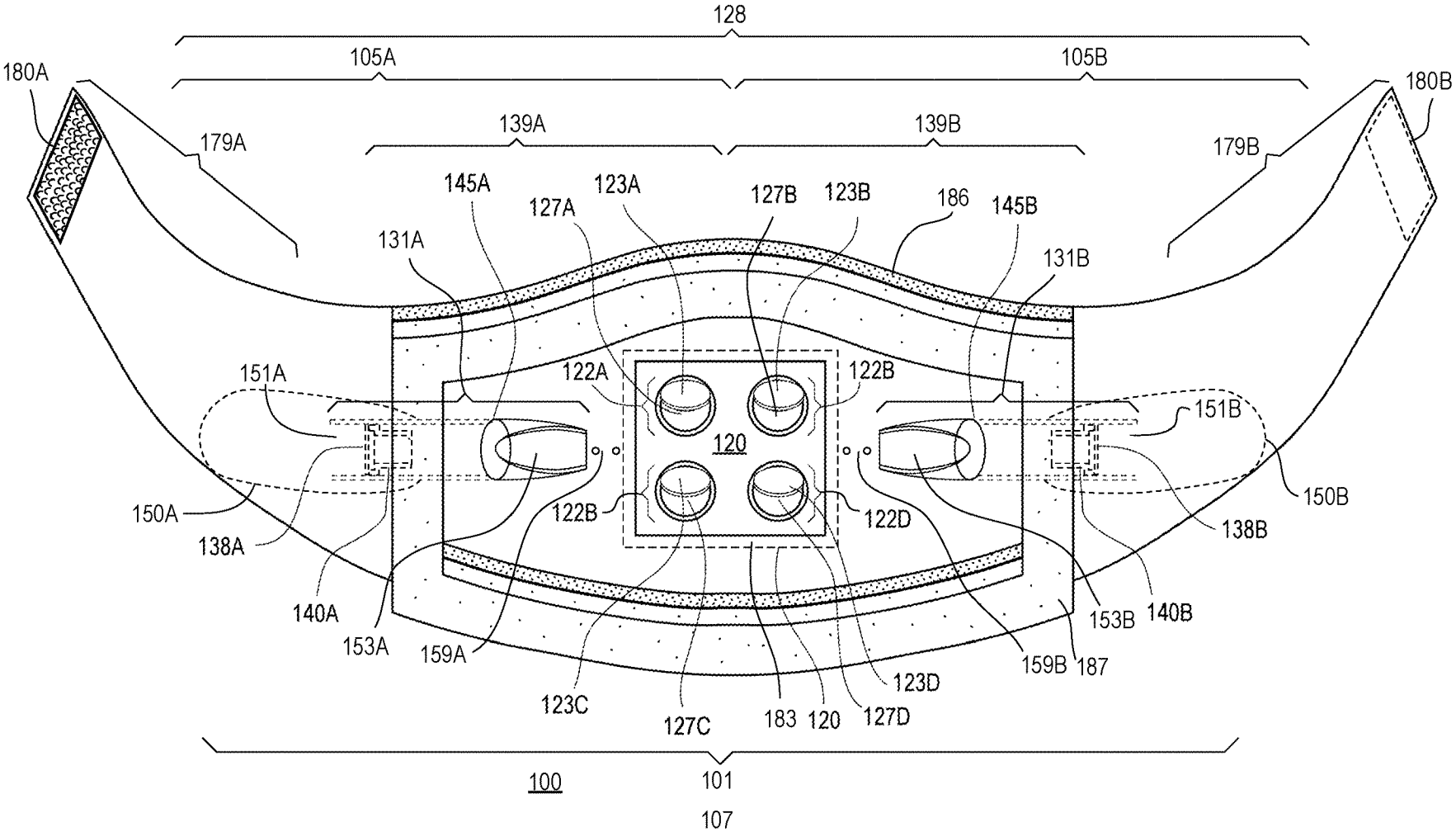
FIGS. 3A-3C are a set of three drawings of a dual filtration COVID-19 mask configured to allow a user to breathe, showing the mask during the user's intake breath.
Figure 3B:
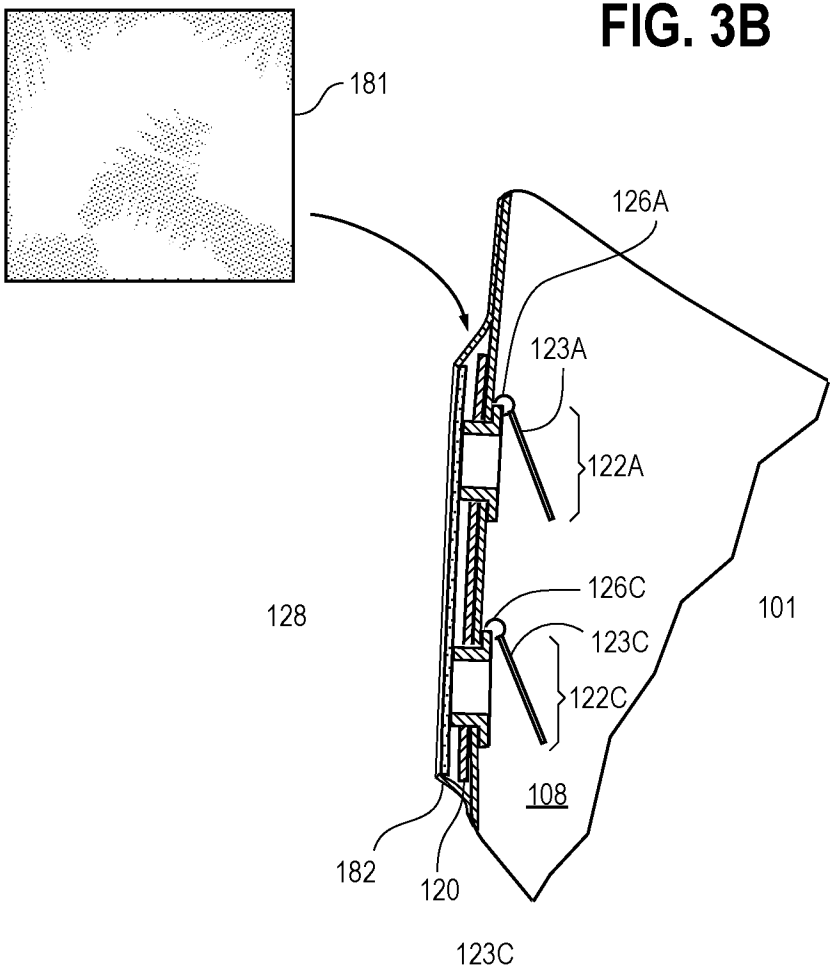
Figure 3C:
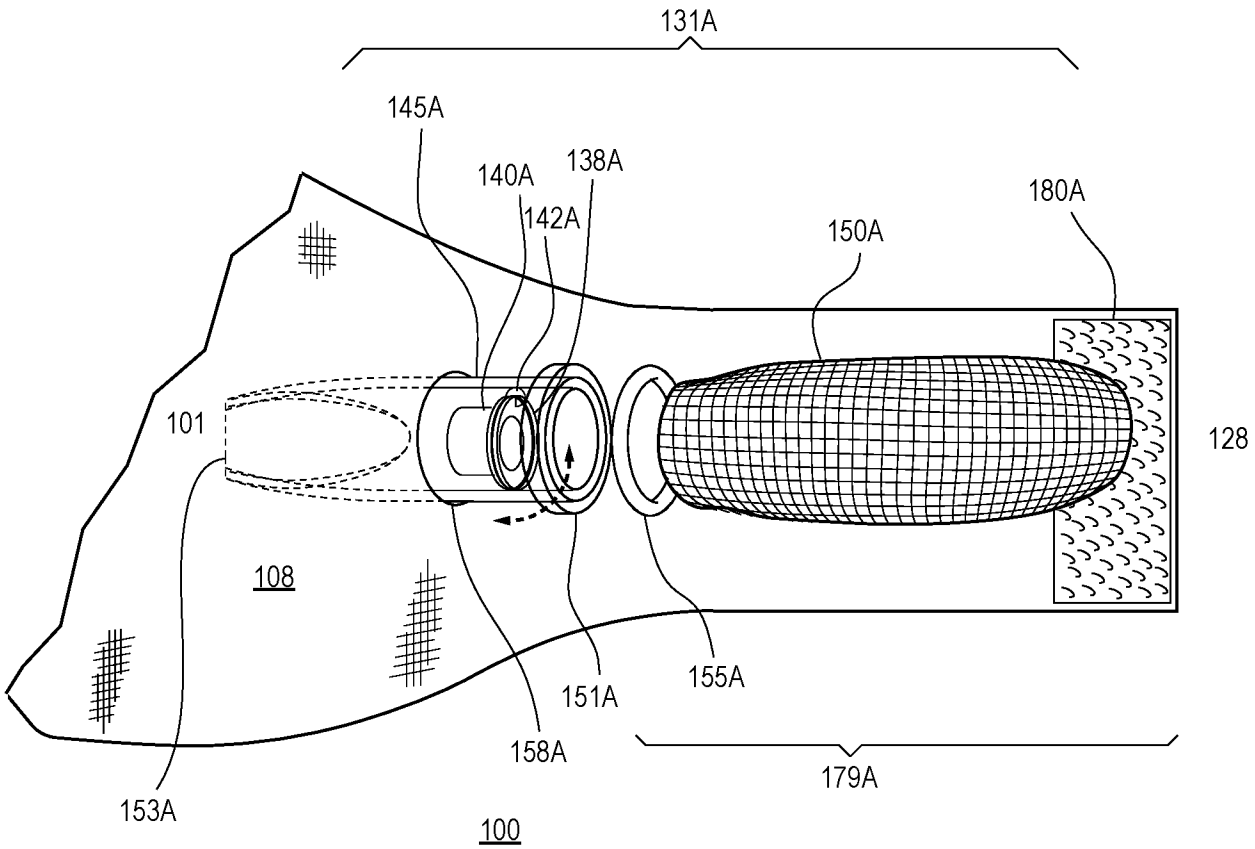

FIGS. 3A-3C are a set of three drawings of a dual filtration COVID-19 mask 100 configured to allow a user to breathe, showing the mask 100 prior to use. FIGS. 3A-3C show the mask 100 as it appears during the user's intake breath.

FIG. 3A is a drawing showing an interior view of the dual filtration COVID-19 mask 100 as seen from an inside 101 of the mask 100. The mask 100 is configured to allow the user (not shown) to breathe, showing the mask 100 prior to use. FIG. 3A depicts the mask 100 as it appears during the user's intake breath. The mask 100 (the "left side" and "right side" descriptors are as seen in the interior view shown in FIGS. 1A-1B and in this figure) again comprises the mask left side 105A, the mask right side 105B, and the mask center 107.

The mask 100 again further comprises the mask base 108. The mask base 108 again comprises the intake valve panel 120. The intake valve panel 120 again comprises the one or more intake valve assemblies 122A-122D.

At least one of the intake valve assemblies 122A-122D again comprises a respective intake valve 123A-123D, at least one of the one or more intake valves 123A-123D again configured to open to transmit the user's intake breath. Preferably, but not necessarily, and as depicted, each of the one or more intake valves 123A-123D is again configured to open to transmit the user's intake breath. The intake valves 123A-123D are open because the user is currently breathing an intake breath.

The intake valve panel 120 again further comprises one or more base intake holes 127A-127D, wherein at least one of the base intake holes 127A-127D again is configured snugly to hold a corresponding intake valve 123A-123D while allowing the user's intake breath to pass from the outside 128 of the mask 100 to the inside 101 of the mask 100. Preferably, but not necessarily, and as depicted, each of the base intake holes 127A-127D is configured to snugly hold the corresponding intake valve 123A-123D while allowing the user's intake breath to pass from the outside 128 of the mask 100 to the inside 101 of the mask 100.

The mask base 108 again further comprises the left exhaust valve assembly 131A and the right exhaust valve assembly 131B the left base anchor 159A, and the right base anchor 159B.

The left exhaust valve assembly 131A again comprises the left exhaust valve 138A. The right exhaust valve assembly again comprises the right exhaust valve 138B. One or more of the left exhaust valve 138A and the right exhaust valve 138B again are configured to open to transmit the user's exhale breath. Preferably, but not necessarily, and as depicted, both the left exhaust valve 138A and the right exhaust valve 138B again are configured to open to transmit the user's exhale breath. At least one of the one or more exhaust valves 138A-138B again is configured to close promptly after transmission of the user's exhale breath. One or more of the left exhaust valve 138A and the right exhaust valve 138B again are configured to close promptly after transmission of the user's exhale breath. Preferably, but not necessarily, and as depicted, each of the exhaust valves 138A-138B again is configured to close promptly after transmission of the user's exhale breath. The left exhaust valve 138A and the right exhaust valve 138B are closed because the user is not currently breathing an exhale breath. The exhaust valves 138A-138B again are positioned at the respective exhaust-intake distances 139A-139B from the intake valve panel 120.

The left exhaust valve assembly 131A again further comprises the left exhaust valve base 140A and the left exhaust tube 145A. The right exhaust valve assembly 131B again comprises the right exhaust valve base 140B and the right exhaust tube 145B.

The left exhaust tube 145A again further comprises the left exhaust filter 150A. The right exhaust tube 145B again further comprises the right exhaust filter 150B.

The left exhaust tube 145A again further comprises the left exhaust filter 150A the left exhaust filter 150A again configured to filter a first portion of the user's exhale breath through the right exhaust tube 145B. The right exhaust tube 145B again further comprises the right exhaust filter 150B the right exhaust filter 150B again configured to filter a second portion of the user's exhale breath through the right exhaust tube 145B.

The left exhaust tube 145A again further comprises the left exhaust tube exhaust end 151A that is close to the left exhaust valve 138A. The right exhaust tube 145B again further comprises the right exhaust tube exhaust end 151B that is close to the right exhaust valve 138B.

The left exhaust filter 150A again is attached to the left exhaust tube 145A near the left exhaust tube exhaust end 151A. The right exhaust filter 150B again is attached to the right exhaust tube 145A near the right exhaust tube exhaust end 151B.

The left exhaust tube 145A again further comprises the left exhaust tube base end 153A that is close to the mask base 108. The right exhaust tube 145B again further comprises the right exhaust tube base end 153B that is close to the mask base 108.

Preferably, but not necessarily, and as depicted, the left exhaust filter 150A again comprises the left exhaust filter fastener 155A configured to fasten the left exhaust filter 150A onto the left exhaust tube 145A. Preferably, but not necessarily, and as depicted, the right exhaust filter 150B again comprises the right exhaust filter fastener 155B configured to fasten the right exhaust filter 150B onto the right exhaust tube 145B.

The mask 100 again further comprises the mask cover 178, the mask cover 178 again configured to cover the outside 128 of the mask 100. The mask cover 178 is again attached to the mask base 108.

The mask cover 178 again comprises one or more of the left strap 179A and the right strap 179B. Preferably, but not necessarily, and as depicted, the mask cover 178 again comprises both the left strap 179A and the right strap 179B. The left strap 179A again comprises the left strap connector 180A. The right strap 179B again comprises the right strap connector 180B. The left strap connector 180A and the right strap connector 180B again are connectable to hold the mask 100 on the user's face (not shown).

The mask cover 178 again further comprises the intake filter 181, which again is configured to filter the user's intake breath through the intake valve panel 120.

The mask cover 178 again further comprises the intake hole 183, which is again configured to allow the user's intake breath to pass from the outside 128 of the mask 100 to the intake valve panel 120 and then through the intake filters 123A-123D to the inside 101 of the mask 100.

The mask 100 again further comprises the soft foam lining 186, which is again configured to comfortably hold the mask 100 against the user's face (not shown).

The mask 100 again further comprises the hard foam lining 187, which again is attached to the soft foam lining 186. The hard foam lining 187 again is configured to hold the intake valve panel 120 at a distance from the user's face (not shown), thereby allowing the intake valves 123A-123D to open and close freely. Preferably, but not necessarily, and as depicted, the hard foam lining 187 again surrounds the soft foam lining 186. The hard foam lining 187 is again attached to the base.

Components of the mask 100 that are not visible in FIG. 3A include the intake valve bases (items 124A-124D in FIG. 1A), the base intake holes (items 125A-125D in FIG. 1A), the intake valve hinges (items 126A-126D in FIGS. 1A, 2B, 2D, 3B, 4B, 5F, and 5H), the left exhaust valve hinge (item 142A in FIGS. 1A, 1B, 2C, 3C, 4C, and 5E-5H), the right exhaust valve hinge (item 142B in FIGS. 1A, 1B, 2C, 3C, 4C, and 5E-5H), the left exhaust valve diameter and the right exhaust valve diameter (items 143A and 143B in FIG. 1A), the left exhaust tube and the right exhaust tube (items 145A and 145B in FIGS. 1A, 1B, 2C, 3C, 4C, and 5F-5H), the left exhaust tube inner diameter and the right exhaust tube inner diameter (items 146A and 146B in FIGS. 1A and 1B), the left exhaust tube outer diameter and the right exhaust tube outer diameter (items 147A and 147B in FIGS. 1A and 1B), the left valve to end distance and the right valve to end distance (items 152A and 152B in FIGS. 1A and 1B), the left exhaust filter fastener (item 155A in FIGS. 1A, 1B, 2B, 3B, and 4B), the right exhaust filter fastener (item 155B in FIGS. 1A and 1B; also not shown in FIGS. 2B, 3B, and 4B), the left base exhaust hole and the right base exhaust hole (items 158A-158B in FIGS. 1A, 2C, 3C, 4C, and 5B-5H), the intake filter slot (item 182 in FIGS. 1A, 2B, 3B, and 4B), the intake hole (item 183 in FIGS. 1A and 1B), and the left cover exhaust hole and the right cover exhaust hole (items 184A and 184B in FIG. 1A).

FIG. 3B is a drawing showing a left side cross section view of a front portion of the mask 100 configured to allow the user (not shown) to breathe, showing the mask 100 prior to use. FIG. 3B depicts the mask 100 as it appears during the user's intake breath.

The mask 100 again comprises the mask base 108. The mask base 108 again comprises the intake valve panel 120. The intake valve panel 120 again comprises the one or more intake valve assemblies 122A-122D.

At least one of the intake valve assemblies 122A-122D again comprises a respective intake valve 123A-123D, at least one of the one or more intake valves 123A-123D again configured to open to transmit the user's intake breath from the outside 128 of the mask 100 to the inside 101 of the mask 100. Preferably, but not necessarily, and as depicted, each of the one or more intake valves 123A-123D again is configured to open to transmit the user's intake breath. The intake valves 123A-123D are open because the user is currently breathing an intake breath.

The mask base 108 again further comprises the left exhaust valve assembly 131A and the right exhaust valve assembly 131B.

The mask cover 178 again further comprises the intake filter 181, which again is configured to filter the user's intake breath through the intake valve panel 120.

The mask 100 again further comprises the soft foam lining 186, which is again configured to comfortably hold the mask 100 against the user's face (not shown).

The mask 100 again further comprises the hard foam lining 187, which again is attached to the soft foam lining 186. The hard foam lining 187 again is configured to hold the intake valve panel 120 at a distance from the user's face (not shown), thereby allowing the intake valves 123A-123D to open and close freely. Preferably, but not necessarily, and as depicted, the hard foam lining 187 again surrounds the soft foam lining 186. The hard foam lining 187 is again attached to the base 108.

The mask 100 further comprises an intake filter slot 182 configured to receive the intake filter 181, the intake filter slot 182 further configured to hold the intake filter 181 firmly in place.

Components of the mask 100 that are not visible in FIG. 3B include the mask left side and the mask right side (items 105A-105B in FIGS. 1A-1C, 2A, 3A, and 4A), the mask center (item 107 in FIGS. 1A-1C, 2A, 2C, 2D, 3A, 3C, 4A, and 5F-5H), the intake valve bases (items 124A-124D in FIG. 1A), the base intake holes (items 125A-125D in FIG. 1A), the base intake holes (items 127A-127D in FIGS. 1A, 1B, 2A, 3A, 4A, and 5B-5H), the left exhaust valve assembly (item 131A in FIGS. 1A, 1B, 2A, 2C, 3A, 3C, 4A, 4C, and 5E-5H), the right exhaust valve assembly (item 131B in FIGS. 1A, 1B, 2A, 3A, 4A, and 5E-5H), the left exhaust valve (item 138A in FIGS. 1A, 1B, 2A, 2C, 3A, 3C, 4A, 4C, and 5E-5H), the right exhaust valve (item 138B in FIGS. 1A, 1B, 2A, 3A, 4A, and 5E-5H), the left exhaust valve base (item 140A in FIGS. 1A, 1B, 2A, 2C, 3A, 3C, 4A, 4C, and 5E-5H), the right exhaust valve base (item 140B in FIGS. 1A, 1B, 2A, 3A, 4A, and 5E-5H), the left exhaust valve base hole (item 141A in FIG. 1A), the right exhaust valve base hole (item 141B in FIG. 1A), the left exhaust valve hinge (item 142A in FIGS. 1A, 1B, 2C, 3C, 4C, and 5E-5H), the right exhaust valve hinge (item 142B in FIGS. 1A, 1B, 2C, 3C, 4C, and 5E-5H), the left exhaust valve diameter and the right exhaust valve diameter (items 143A and 143B in FIG. 1A), the left exhaust tube (item 145A in FIGS. 1A, 1B, 2A, 2C, 3A, 3C, 4A, 4C, and 5E-5H), the right exhaust tube (item 145B in FIGS. 1A, 1B, 2A, 3A, 4A, and 5E-5H), the left exhaust tube inner diameter and the right exhaust tube inner diameter (items 146A and 146B in FIGS. 1A and 1B), the left exhaust tube outer diameter and the right exhaust tube outer diameter (items 147A and 147B in FIGS. 1A and 1B), the left exhaust filter (item 150A in FIGS. 1A, 1B, 2A, 2C, 3A, 3C, 4A, 4C, and 5E-5H), the right exhaust filter (item 150B in FIGS. 1A, 1B, 2A, 3A, 4A, and 5E-5H), the left exhaust tube exhaust end (item 151A in FIGS. 1A, 1B, 2A, 2C, 3A, 3C, 4A, 4C, and 5E-5H), the right exhaust tube exhaust end (item 151B in FIGS. 1A, 1B, 2A, 3A, 4A, and 5E-5H), the left valve to end distance and the right valve to end distance (items 152A and 152B in FIGS. 1A and 1B), the left exhaust tube base end (item 153A in FIGS. 1A, 1B, 2A, 2C, 3A, 3C, 4A, 4C, and 5E-5H), the right exhaust tube base end (item 153B in FIGS. 1A, 1B, 2A, 3A, 4A, and 5E-5H), the left exhaust filter fastener (item 155A in FIGS. 1A, 1B, 2A, 2C, 3A, 3C, 4A, 4C, and 5E-5H), the right exhaust filter fastener (item 155B in FIGS. 1A, 1B, 2A, 3A, 4A, and 5E-5H), the left base exhaust hole (item 158A in FIGS. 1A, 1B, 2A, 2C, 3A, 3C, 4A, 4C, and 5E-5H), the right base exhaust hole (item 158B in FIGS. 1A, 1B, 2A, 3A, 4A, and 5E-5H), the left base anchor and the right base anchor (items 159A-159B in FIG. 1A), the mask cover (item 178 in FIGS. 1A-1C, 2A, 3A, and 4A), the left strap (item 179A in FIGS. 1A-1C, 2A, 2C, 2D, 3A, 3C, 4A, and 4C), the right strap (item 179B in FIGS. 1A-1C, 2A, 3A, and 4A), the left strap connector (item 180A in FIGS. 1A-1C, 2A, 2C, 2D, 3A, 3C, 4A, and 4C), the right strap connector (item 180B in FIGS. 1A-1C, 2A, 3A, and 4A), the intake hole (item 183 in FIGS. 1A and 1B), and the left cover exhaust hole and the right cover exhaust hole (items 184A and 184B in FIG. 1A).

FIG. 3C is a drawing showing an interior view of a left portion of the mask 100 configured to allow the user (not shown) to breathe, showing the mask 100 during the user's intake breath.

The mask 100 again further comprises the mask base 108.

The mask base 108 again comprises the left exhaust valve assembly 131A. The left exhaust valve assembly 131A again comprises the left exhaust valve 138A. The left exhaust valve 138A again is configured to open to transmit the user's exhale breath. The left exhaust valve 138A again is configured to close promptly after transmission of the user's exhale breath. The left exhaust valve 138A is closed because the user is not currently breathing an exhale breath.

The left exhaust valve assembly 131A again further comprises the left exhaust valve base 140A, the left exhaust valve hinge 142A, and the left exhaust tube 145A.

The left exhaust tube 145A again further comprises the left exhaust filter 150A.

The left exhaust tube 145A again further comprises the left exhaust tube exhaust end 151A that is close to the left exhaust valve 138A. The left exhaust tube exhaust end 151A is again located at the left valve to end distance 152A from the left exhaust valve 138A.

The left exhaust filter 150A again is attached to the left exhaust tube 145A near the left exhaust tube exhaust end 151A.

The left exhaust tube 145A again further comprises the left exhaust tube base end 153A that is close to the mask base 108.

Preferably, but not necessarily, and as depicted, the left exhaust filter 150A again comprises the left exhaust filter fastener 155A configured to fasten the left exhaust filter 150A onto the left exhaust tube 145A.

The mask 100 again further comprises the mask cover 178, the mask cover 178 again configured to cover the outside 128 of the mask 100. The mask cover 178 is again attached to the mask base 108.

The mask cover 178 again comprises the left strap 179A. The left strap 179A again comprises the left strap connector 180A.

Components of the mask 100 that are not visible in FIG. 3C include the mask base (item 108 in all other figures) the intake valve panel (item 120 in FIGS. 1A, 1B, 2A, 2B, 2D, 3A, 3B, 4A, and 4B), the intake valve assemblies (items 122A-122D in FIGS. 1A, 1B, 2A, 2B, 2D, 3A, 3B, 4A, 4B, and 5E-5H), the intake valves (items 123A-123D in FIGS. 1A, 1B, 2A, 2B, 2D, 3A, 3B, 4A, 4B, and 5E-5H), the intake valve bases (items 124A-124D in FIG. 1A), the base intake holes (items 125A-125D in FIG. 1A), the intake valve hinges (items 126A-126D in FIGS. 1A, 2B, 2D, 3B, 4B, 5F, and 5H), the base intake holes (items 127A-127D in FIGS. 1A, 1B, 2A, 3A, 4A, and 5B-5H), the right exhaust valve assembly (item 131B in 1A, 1B, 2A, 3A, 4A, and 5E-5H), the right exhaust valve (item 138B in FIGS. 1A, 1B, 2A, 3A, 4A, and 5E-5H), the left exhaust valve base (item 140A in FIGS. 1A, 1B, 2A, 2C, 3A, 3C, 4A, 4C, and 5E-5H), the right exhaust valve base (item 140B in FIGS. 1A, 1B, 2A, 3A, 4A, and 5E-5H), the left exhaust valve base hole (item 141A in FIG. 1A), the right exhaust valve base hole (item 141B in FIG. 1A), the right exhaust valve hinge (item 142B in FIGS. 1A, 1B, 2A, 3A, 4A, and 5E-5H), the left exhaust valve diameter and the right exhaust valve diameter (items 143A and 143B in FIG. 1A), the right exhaust tube (item 145B in FIGS. 1A, 1B, 2A, 3A, 4A, and 5E-5H), the left exhaust tube inner diameter and the right exhaust tube inner diameter (items 146A and 146B in FIGS. 1A and 1B), the left exhaust tube outer diameter and the right exhaust tube outer diameter (items 147A and 147B in FIGS. 1A and 1B), the right exhaust filter (item 150B in FIGS. 1A, 1B, 2A, 3A, 4A, and 5E-5H), the right exhaust tube exhaust end (item 151B in FIGS. 1A, 1B, 2A, 3A, 4A, and 5E-5H), the left valve to end distance and the right valve to end distance (items 152A and 152B in FIGS. 1A and 1B), the right exhaust tube base end (item 153B in FIGS. 1A, 1B, 2A, 3A, 4A, and 5E-5H), the right exhaust filter fastener (item 155B in FIGS. 1A, 1B, 2A, 3A, 4A, and 5E-5H), the right base exhaust hole (item 158B in FIGS. 1A, 1B, 2A, 3A, 4A, and 5E-5H), the left base anchor and the right base anchor (items 159A-159B in FIG. 1A), the right strap (item 179B in FIGS. 1A-1C, 2A, 3A, and 4A), the right strap connector (item 180B in FIGS. 1A-1C, 2A, 3A, and 4A), the intake filter (item 181 in FIGS. 1A, 1B, 1C, 2A, 2B, 3A, 3B, 4A, and 4B). the intake filter slot (item 182 in FIGS. 1A, 2B, 3B, and 4B), the intake hole (item 183 in FIGS. 1A and 1B), the left cover exhaust hole and the right cover exhaust hole (items 184A and 184B in FIG. 1A), the soft foam lining (item 186 in FIGS. 1A, 1B, 2A, 3A, and 4A) and the hard foam lining (item 187 in FIGS. 1A, 1B, 2A, 3A, and 4A).

Figure 4A:
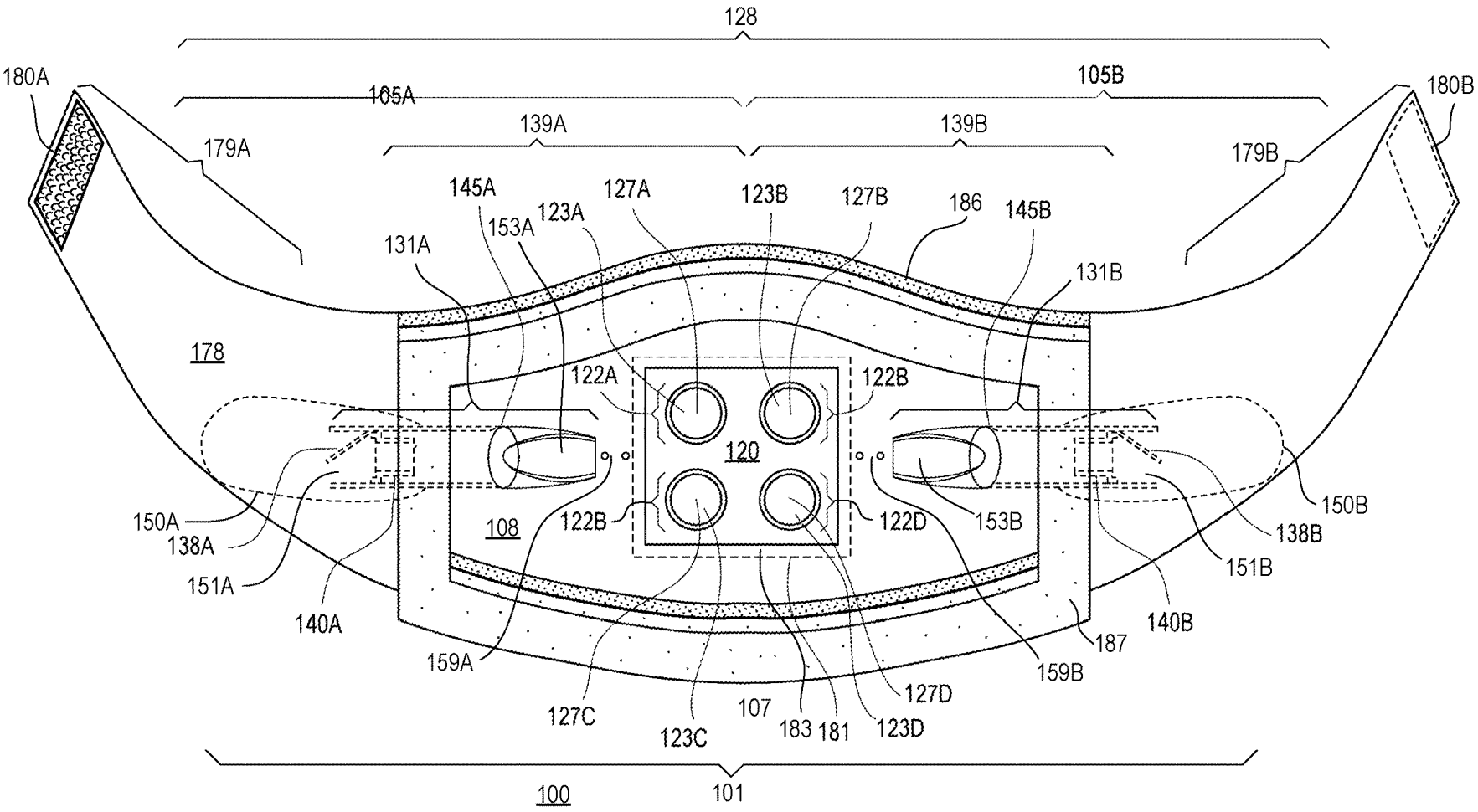
FIGS. 4A-4C are a set of three drawings of a dual filtration COVID-19 mask configured to allow a user to breathe, during the user's exhale breath.
Figure 4B:
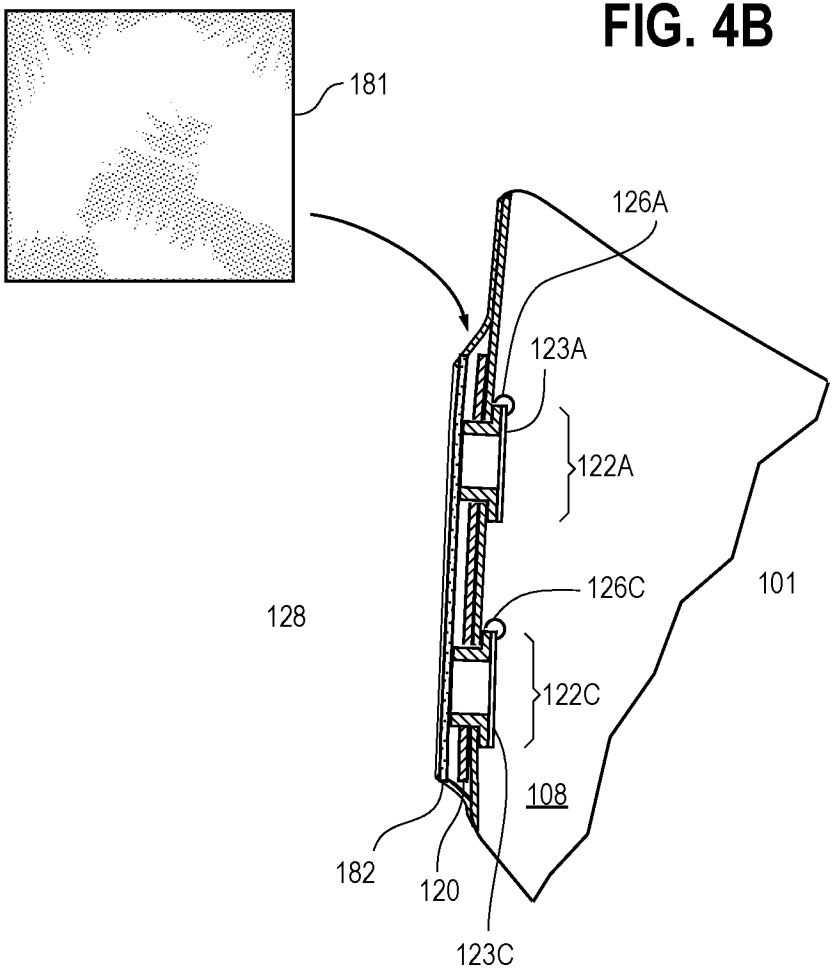
Figure 4C:
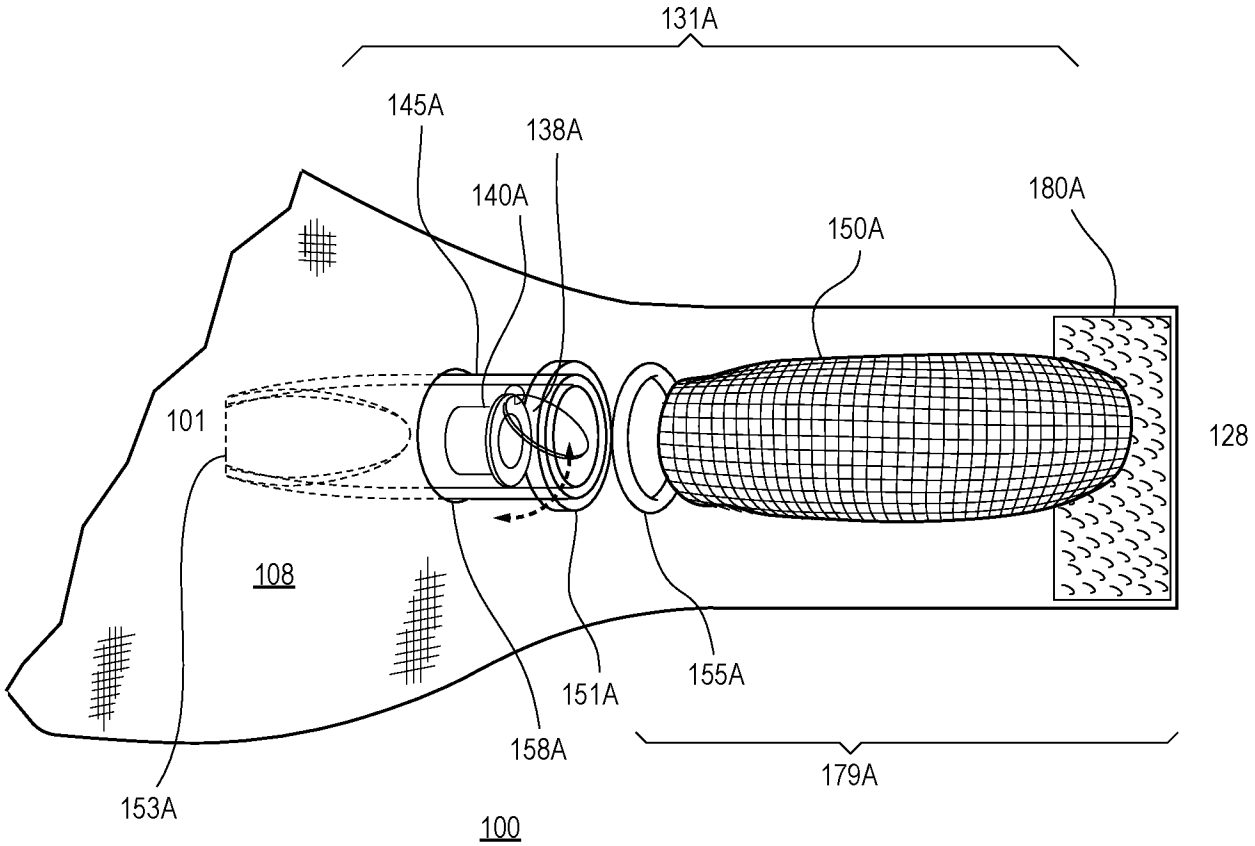

FIGS. 4A-4C are a set of three drawings of a dual filtration COVID-19 mask 100 configured to allow a user to breathe, showing the mask 100 prior to use. FIGS. 4A-4D show the mask 100 as it appears during the user's exhale breath.

FIG. 4A is a drawing showing an interior view of the dual filtration COVID-19 mask 100 as seen from an inside 101 of the mask 100. The mask 100 is configured to allow the user (not shown) to breathe, showing the mask 100 prior to use. FIG. 4A depicts the mask 100 as it appears during the user's exhale breath. The mask 100 (the "left side" and "right side" descriptors are as seen in the interior view shown in FIGS. 1A-1B and in this figure) again comprises the mask left side 105A, the mask right side 105B, and the mask center 107.

The mask 100 again further comprises the mask base 108. The mask base 108 again comprises the intake valve panel 120. The intake valve panel 120 again comprises the one or more intake valve assemblies 122A-122D.

At least one of the intake valve assemblies 122A-122D again comprises a respective intake valve 123A-123D, at least one of the one or more intake valves 123A-123D again configured to open to transmit the user's intake breath. Preferably, but not necessarily, and as depicted, each of the one or more intake valves 123A-123D is again configured to open to transmit the user's intake breath. The intake valves 123A-123D are closed because the user is currently breathing an exhale breath.

The intake valve panel 120 again further comprises one or more base intake holes 127A-127D, wherein at least one of the base intake holes 127A-127D again is configured snugly to hold a corresponding intake valve 123A-123D while allowing the user's intake breath to pass from the outside 128 of the mask 100 to the inside 101 of the mask 100. Preferably, but not necessarily, and as depicted, each of the base intake holes 127A-127D is configured to snugly hold the corresponding intake valve 123A-123D while allowing the user's intake breath to pass from the outside 128 of the mask 100 to the inside 101 of the mask 100.

The mask base 108 again further comprises the left exhaust valve assembly 131A and the right exhaust valve assembly 131B the left base anchor 159A, and the right base anchor 159B.

The left exhaust valve assembly 131A again comprises the left exhaust valve 138A. The right exhaust valve assembly again comprises the right exhaust valve 138B. One or more of the left exhaust valve 138A and the right exhaust valve 138B again are configured to open to transmit the user's exhale breath. Preferably, but not necessarily, and as depicted, both the left exhaust valve 138A and the right exhaust valve 138B again are configured to open to transmit the user's exhale breath. At least one of the one or more exhaust valves 138A-138B again is configured to close promptly after transmission of the user's exhale breath. One or more of the left exhaust valve 138A and the right exhaust valve 138B again are configured to close promptly after transmission of the user's exhale breath. Preferably, but not necessarily, and as depicted, each of the exhaust valves 138A-138B again is configured to close promptly after transmission of the user's exhale breath. The left exhaust valve 138A and the right exhaust valve 138B are open because the user is currently breathing an exhale breath. The exhaust valves 138A-138B again are positioned at the respective exhaust-intake distances 139A-139B from the intake valve panel 120.

The left exhaust valve assembly 131A again further comprises the left exhaust valve base 140A and the left exhaust tube 145A. The right exhaust valve assembly 131B again comprises the right exhaust valve base 140B and the right exhaust tube 145B.

The left exhaust tube 145A again further comprises the left exhaust filter 150A. The right exhaust tube 145B again further comprises the right exhaust filter 150B.

The left exhaust tube 145A again further comprises the left exhaust filter 150A the left exhaust filter 150A again configured to filter a first portion of the user's exhale breath through the right exhaust tube 145B. The right exhaust tube 145B again further comprises the right exhaust filter 150B the right exhaust filter 150B again configured to filter a second portion of the user's exhale breath through the right exhaust tube 145B.

The left exhaust tube 145A again further comprises the left exhaust tube exhaust end 151A that is close to the left exhaust valve 138A. The right exhaust tube 145B again further comprises the right exhaust tube exhaust end 151B that is close to the right exhaust valve 138B.

The left exhaust filter 150A again is attached to the left exhaust tube 145A near the left exhaust tube exhaust end 151A. The right exhaust filter 150B again is attached to the right exhaust tube 145A near the right exhaust tube exhaust end 151B.

The left exhaust tube 145A again further comprises the left exhaust tube base end 153A that is close to the mask base 108. The right exhaust tube 145B again further comprises the right exhaust tube base end 153B that is close to the mask base 108.

Preferably, but not necessarily, and as depicted, the left exhaust filter 150A again comprises the left exhaust filter fastener 155A configured to fasten the left exhaust filter 150A onto the left exhaust tube 145A. Preferably, but not necessarily, and as depicted, the right exhaust filter 150B again comprises the right exhaust filter fastener 155B configured to fasten the right exhaust filter 150B onto the right exhaust tube 145B.

The mask 100 again further comprises the mask cover 178, the mask cover 178 again configured to cover the outside 128 of the mask 100. The mask cover 178 is again attached to the mask base 108.

The mask cover 178 again comprises one or more of the left strap 179A and the right strap 179B. Preferably, but not necessarily, and as depicted, the mask cover 178 again comprises both the left strap 179A and the right strap 179B. The left strap 179A again comprises the left strap connector 180A. The right strap 179B again comprises the right strap connector 180B. The left strap connector 180A and the right strap connector 180B again are connectable to hold the mask 100 on the user's face (not shown).

The mask cover 178 again further comprises the intake filter 181, which again is configured to filter the user's intake breath through the intake valve panel 120.

The mask cover 178 again further comprises the intake hole 183, which is again configured to allow the user's intake breath to pass from the outside 128 of the mask 100 to the intake valve panel 120 and then through the intake filters 123A-123D to the inside 101 of the mask 100.

The mask 100 again further comprises the soft foam lining 186, which is again configured to comfortably hold the mask 100 against the user's face (not shown).

The mask 100 again further comprises the hard foam lining 187, which again is attached to the soft foam lining 186. The hard foam lining 187 again is configured to hold the intake valve panel 120 at a distance from the user's face (not shown), thereby allowing the intake valves 123A-123D to open and close freely. Preferably, but not necessarily, and as depicted, the hard foam lining 187 again surrounds the soft foam lining 186. The hard foam lining 187 is again attached to the base.

Components of the mask 100 that are not visible in FIG. 4A include the intake valve bases (items 124A-124D in FIG. 1A), the base intake holes (items 125A-125D in FIG. 1A), the intake valve hinges (items 126A-126D in FIGS. 1A, 2B, 2D, 3B, 4B, 5F, and 5H), the left exhaust valve hinge (item 142A in FIGS. 1A, 1B, 2C, 3C, 4C, and 5E-5H), the right exhaust valve hinge (item 142B in FIGS. 1A, 1B, 2C, 3C, 4C, and 5E-5H), the left exhaust valve diameter and the right exhaust valve diameter (items 143A and 143B in FIG. 1A), the left exhaust tube and the right exhaust tube (items 145A and 145B in FIGS. 1A, 1B, 2C, 3C, 4C, and 5F-5H), the left exhaust tube inner diameter and the right exhaust tube inner diameter (items 146A and 146B in FIGS. 1A and 1B), the left exhaust tube outer diameter and the right exhaust tube outer diameter (items 147A and 147B in FIGS. 1A and 1B), the left valve to end distance and the right valve to end distance (items 152A and 152B in FIGS. 1A and 1B), the left exhaust filter fastener (item 155A in FIGS. 1A, 1B, 2B, 3B, and 4B), the right exhaust filter fastener (item 155B in FIGS. 1A and 1B; also not shown in FIGS. 2B, 3B, and 4B), the left base exhaust hole and the right base exhaust hole (items 158A-158B in FIGS. 1A, 2C, 3C, 4C, and 5B-5H), the intake filter slot (item 182 in FIGS. 1A, 2B, 3B, and 4B), the intake hole (item 183 in FIGS. 1A and 1B), and the left cover exhaust hole and the right cover exhaust hole (items 184A and 184B in FIG. 1A).

FIG. 4B is a drawing showing a left side cross section view of a front portion of the mask 100 configured to allow the user (not shown) to breathe, showing the mask 100 prior to use. FIG. 4B depicts the mask 100 as it appears during the user's exhale breath.

The mask 100 again comprises the mask base 108. The mask base 108 again comprises the intake valve panel 120. The intake valve panel 120 again comprises the one or more intake valve assemblies 122A-122D.

At least one of the intake valve assemblies 122A-122D again comprises a respective intake valve 123A-123D, at least one of the one or more intake valves 123A-123D again configured to open to transmit the user's intake breath from the outside 128 of the mask 100 to the inside 101 of the mask 100. Preferably, but not necessarily, and as depicted, each of the one or more intake valves 123A-123D again is configured to open to transmit the user's intake breath. The intake valves 123A-123D are open because the user is currently breathing an intake breath.

The mask base 108 again further comprises the left exhaust valve assembly 131A and the right exhaust valve assembly 131B.

The mask cover 178 again further comprises the intake filter 181, which again is configured to filter the user's intake breath through the intake valve panel 120.

The mask 100 again further comprises the soft foam lining 186, which is again configured to comfortably hold the mask 100 against the user's face (not shown).

The mask 100 again further comprises the hard foam lining 187, which again is attached to the soft foam lining 186. The hard foam lining 187 again is configured to hold the intake valve panel 120 at a distance from the user's face (not shown), thereby allowing the intake valves 123A-123D to open and close freely. Preferably, but not necessarily, and as depicted, the hard foam lining 187 again surrounds the soft foam lining 186. The hard foam lining 187 is again attached to the base 108.

The mask 100 further comprises an intake filter slot 182 configured to receive the intake filter 181, the intake filter slot 182 further configured to hold the intake filter 181 firmly in place.

Components of the mask 100 that are not visible in FIG. 4B include the mask left side and the mask right side (items 105A-105B in FIGS. 1A-1C, 2A, 3A, and 4A), the mask center (item 107 in FIGS. 1A-1C, 2A, 2C, 2D, 3A, 3C, 4A, and 5F-5H), the intake valve bases (items 124A-124D in FIG. 1A), the base intake holes (items 125A-125D in FIG. 1A), the base intake holes (items 127A-127D in FIGS. 1A, 1B, 2A, 3A, 4A, and 5B-5H), the left exhaust valve assembly (item 131A in FIGS. 1A, 1B, 2A, 2C, 3A, 3C, 4A, 4C, and 5E-5H), the right exhaust valve assembly (item 131B in FIGS. 1A, 1B, 2A, 3A, 4A, and 5E-5H), the left exhaust valve (item 138A in FIGS. 1A, 1B, 2A, 2C, 3A, 3C, 4A, 4C, and 5E-5H), the right exhaust valve (item 138B in FIGS. 1A, 1B, 2A, 3A, 4A, and 5E-5H), the left exhaust valve base (item 140A in FIGS. 1A, 1B, 2A, 2C, 3A, 3C, 4A, 4C, and 5E-5H), the right exhaust valve base (item 140B in FIGS. 1A, 1B, 2A, 3A, 4A, and 5E-5H), the left exhaust valve base hole (item 141A in FIG. 1A), the right exhaust valve base hole (item 141B in FIG. 1A), the left exhaust valve hinge (item 142A in FIGS. 1A, 1B, 2C, 3C, 4C, and 5E-5H), the right exhaust valve hinge (item 142B in FIGS. 1A, 1B, 2C, 3C, 4C, and 5E-5H), the left exhaust valve diameter and the right exhaust valve diameter (items 143A and 143B in FIG. 1A), the left exhaust tube (item 145A in FIGS. 1A, 1B, 2A, 2C, 3A, 3C, 4A, 4C, and 5E-5H), the right exhaust tube (item 145B in FIGS. 1A, 1B, 2A, 3A, 4A, and 5E-5H), the left exhaust tube inner diameter and the right exhaust tube inner diameter (items 146A and 146B in FIGS. 1A and 1B), the left exhaust tube outer diameter and the right exhaust tube outer diameter (items 147A and 147B in FIGS. 1A and 1B), the left exhaust filter (item 150A in FIGS. 1A, 1B, 2A, 2C, 3A, 3C, 4A, 4C, and 5E-5H), the right exhaust filter (item 150B in FIGS. 1A, 1B, 2A, 3A, 4A, and 5E-5H), the left exhaust tube exhaust end (item 151A in FIGS. 1A, 1B, 2A, 2C, 3A, 3C, 4A, 4C, and 5E-5H), the right exhaust tube exhaust end (item 151B in FIGS. 1A, 1B, 2A, 3A, 4A, and 5E-5H), the left valve to end distance and the right valve to end distance (items 152A and 152B in FIGS. 1A and 1B), the left exhaust tube base end (item 153A in FIGS. 1A, 1B, 2A, 2C, 3A, 3C, 4A, 4C, and 5E-5H), the right exhaust tube base end (item 153B in FIGS. 1A, 1B, 2A, 3A, 4A, and 5E-5H), the left exhaust filter fastener (item 155A in FIGS. 1A, 1B, 2A, 2C, 3A, 3C, 4A, 4C, and 5E-5H), the right exhaust filter fastener (item 155B in FIGS. 1A, 1B, 2A, 3A, 4A, and 5E-5H), the left base exhaust hole (item 158A in FIGS. 1A, 1B, 2A, 2C, 3A, 3C, 4A, 4C, and 5E-5H), the right base exhaust hole (item 158B in FIGS. 1A, 1B, 2A, 3A, 4A, and 5E-5H), the left base anchor and the right base anchor (items 159A-159B in FIG. 1A), the mask cover (item 178 in FIGS. 1A-1C, 2A, 3A, and 4A), the left strap (item 179A in FIGS. 1A-1C, 2A, 2C, 2D, 3A, 3C, 4A, and 4C), the right strap (item 179B in FIGS. 1A-1C, 2A, 3A, and 4A), the left strap connector (item 180A in FIGS. 1A-1C, 2A, 2C, 2D, 3A, 3C, 4A, and 4C), the right strap connector (item 180B in FIGS. 1A-1C, 2A, 3A, and 4A), the intake hole (item 183 in FIGS. 1A and 1B), and the left cover exhaust hole and the right cover exhaust hole (items 184A and 184B in FIG. 1A).

FIG. 4C is a drawing showing an interior view of a left portion of the mask 100 configured to allow the user (not shown) to breathe, showing the mask 100 during the user's exhale breath.

The mask 100 again further comprises the mask base 108.

The mask base 108 again comprises the left exhaust valve assembly 131A. The left exhaust valve assembly 131A again comprises the left exhaust valve 138A. The left exhaust valve 138A again is configured to open to transmit the user's exhale breath. The left exhaust valve 138A again is configured to close promptly after transmission of the user's exhale breath. The left exhaust valve 138A is open because the user is currently breathing an exhale breath.

The left exhaust valve assembly 131A again further comprises the left exhaust valve base 140A, the left exhaust valve hinge 142A, and the left exhaust tube 145A.

The left exhaust tube 145A again further comprises the left exhaust filter 150A.

The left exhaust tube 145A again further comprises the left exhaust tube exhaust end 151A that is close to the left exhaust valve 138A. The left exhaust tube exhaust end 151A is again located at the left valve to end distance 152A from the left exhaust valve 138A.

The left exhaust filter 150A again is attached to the left exhaust tube 145A near the left exhaust tube exhaust end 151A.

The left exhaust tube 145A again further comprises the left exhaust tube base end 153A that is close to the mask base 108.

Preferably, but not necessarily, and as depicted, the left exhaust filter 150A again comprises the left exhaust filter fastener 155A configured to fasten the left exhaust filter 150A onto the left exhaust tube 145A.

The mask 100 again further comprises the mask cover 178, the mask cover 178 again configured to cover the outside 128 of the mask 100. The mask cover 178 is again attached to the mask base 108.

The mask cover 178 again comprises the left strap 179A. The left strap 179A again comprises the left strap connector 180A.

Components of the mask 100 that are not visible in FIG. 4C include the mask base (item 108 in all other figures) the intake valve panel (item 120 in FIGS. 1A, 1B, 2A, 2B, 2D, 3A, 3B, 4A, and 4B), the intake valve assemblies (items 122A-122D in FIGS. 1A, 1B, 2A, 2B, 2D, 3A, 3B, 4A, 4B, and 5E-5H), the intake valves (items 123A-123D in FIGS. 1A, 1B, 2A, 2B, 2D, 3A, 3B, 4A, 4B, and 5E-5H), the intake valve bases (items 124A-124D in FIG. 1A), the base intake holes (items 125A-125D in FIG. 1A), the intake valve hinges (items 126A-126D in FIGS. 1A, 2B, 2D, 3B, 4B, 5F, and 5H), the base intake holes (items 127A-127D in FIGS. 1A, 1B, 2A, 3A, 4A, and 5B-5H), the right exhaust valve assembly (item 131B in 1A, 1B, 2A, 3A, 4A, and 5E-5H), the right exhaust valve (item 138B in FIGS. 1A, 1B, 2A, 3A, 4A, and 5E-5H), the left exhaust valve base (item 140A in FIGS. 1A, 1B, 2A, 2C, 3A, 3C, 4A, 4C, and 5E-5H), the right exhaust valve base (item 140B in FIGS. 1A, 1B, 2A, 3A, 4A, and 5E-5H), the left exhaust valve base hole (item 141A in FIG. 1A), the right exhaust valve base hole (item 141B in FIG. 1A), the right exhaust valve hinge (item 142B in FIGS. 1A, 1B, 2A, 3A, 4A, and 5E-5H), the left exhaust valve diameter and the right exhaust valve diameter (items 143A and 143B in FIG. 1A), the right exhaust tube (item 145B in FIGS. 1A, 1B, 2A, 3A, 4A, and 5E-5H), the left exhaust tube inner diameter and the right exhaust tube inner diameter (items 146A and 146B in FIGS. 1A and 1B), the left exhaust tube outer diameter and the right exhaust tube outer diameter (items 147A and 147B in FIGS. 1A and 1B), the right exhaust filter (item 150B in FIGS. 1A, 1B, 2A, 3A, 4A, and 5E-5H), the right exhaust tube exhaust end (item 151B in FIGS. 1A, 1B, 2A, 3A, 4A, and 5E-5H), the left valve to end distance and the right valve to end distance (items 152A and 152B in FIGS. 1A and 1B), the right exhaust tube base end (item 153B in FIGS. 1A, 1B, 2A, 3A, 4A, and 5E-5H), the right exhaust filter fastener (item 155B in FIGS. 1A, 1B, 2A, 3A, 4A, and 5E-5H), the right base exhaust hole (item 158B in FIGS. 1A, 1B, 2A, 3A, 4A, and 5E-5H), the left base anchor and the right base anchor (items 159A-159B in FIG. 1A), the right strap (item 179B in FIGS. 1A-1C, 2A, 3A, and 4A), the right strap connector (item 180B in FIGS. 1A-1C, 2A, 3A, and 4A), the intake filter (item 181 in FIGS. 1A, 1B, 1C, 2A, 2B, 3A, 3B, 4A, and 4B). the intake filter slot (item 182 in FIGS. 1A, 2B, 3B, and 4B), the intake hole (item 183 in FIGS. 1A and 1B), the left cover exhaust hole and the right cover exhaust hole (items 184A and 184B in FIG. 1A), the soft foam lining (item 186 in FIGS. 1A, 1B, 2A, 3A, and 4A) and the hard foam lining (item 187 in FIGS. 1A, 1B, 2A, 3A, and 4A).

For example, the mask 100 again further comprises the base (not shown in FIGS. 2A, 3A, and 4A; item 108 in FIG. 1B) attached to the hard foam lining, the base (not shown in FIGS. 2A, 3A, and 4A; item 108 in FIG. 1B) configured to hold one or more of the intake valve panel 120, the intake filter 181, the left exhaust valve 138A, and the right exhaust valve 138B. Preferably, but not necessarily, and as depicted, the base (not shown in FIGS. 2A, 3A, and 4A; item 108 in FIG. 1B) is configured to hold each of the intake valve panel 120, the left exhaust valve 138A, and the right exhaust valve 138B.

FIGS. 5A-5H are a set of eight drawings showing an exemplary method for construction of a cardboard mask base usable in the dual filtration COVID-19 mask configured to allow a user to breathe.

the cardboard base may be constructed by cutting in the base a pair of slices having a length of approximately one inch, and subsequently, by pulling two sides of the mask base together, thereby creating a three-dimensional, domed base. The dome of the mask accommodates a user's mouth. Then one or more of a hard foam lining and a soft foam lining is attached around edges of an inner side of the base. The one or more of the hard foam lining and the soft foam lining helps to keep the mask at a distance from a user's face and more specifically, at a distance from lips of the user so that the intake valves are held at a distance from the user's lips.

Figure 5A:
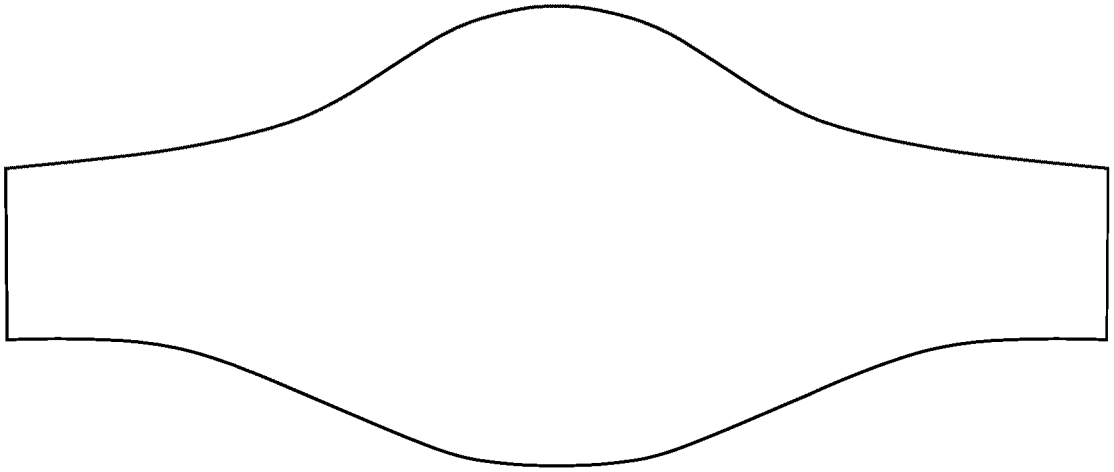
FIGS. 5A-5H are a set of eight drawings showing an exemplary method for construction of a cardboard mask base usable in the dual filtration COVID-19 mask configured to allow a user to breathe.

In FIG. 5A, a cardboard mask base 108 is cut out of a larger piece of cardboard (not shown).

Figure 5B:
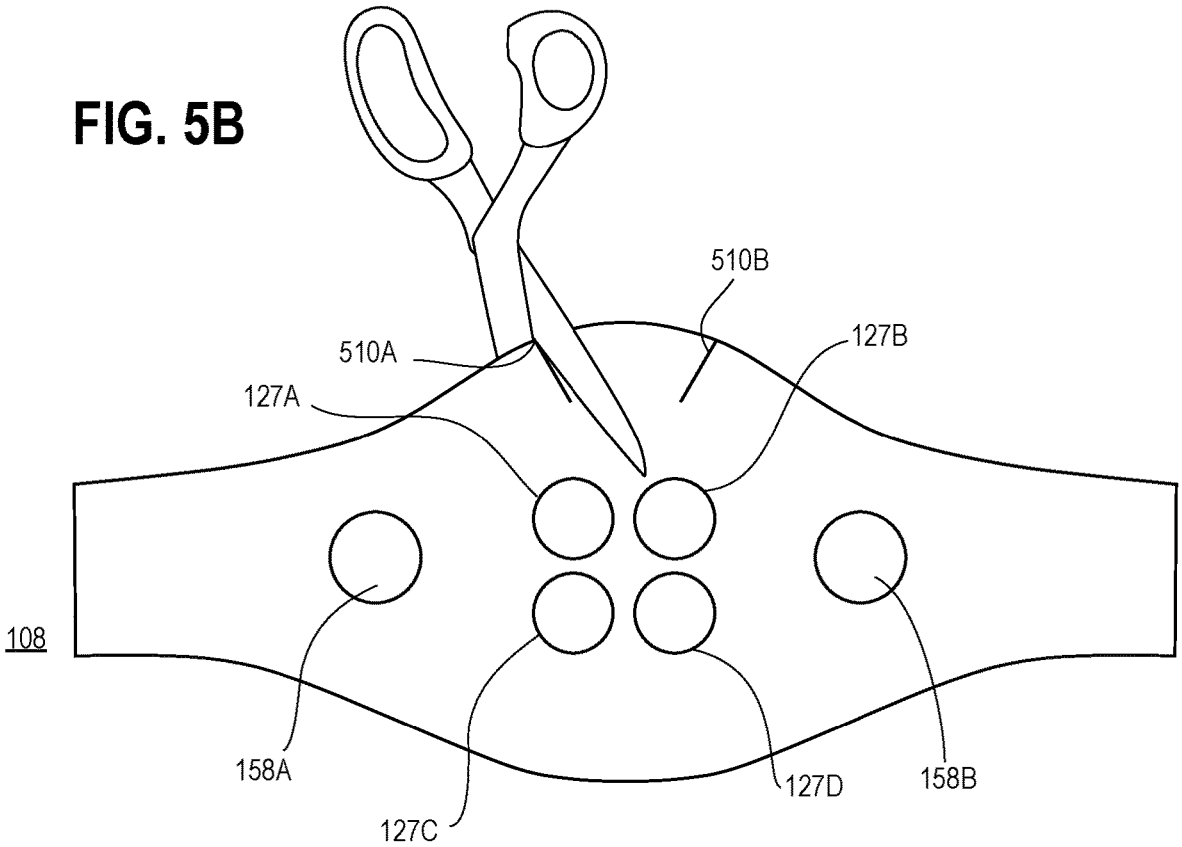

In FIG. 5B, a pair of slits 510A-510B are cut in the cardboard mask base 108. Four base intake holes 127A-127D are cut in the cardboard mask base 108. A left base exhaust hole 158A and a right base exhaust hole 158B are cut in the cardboard mask base 108.

Figure 5C:
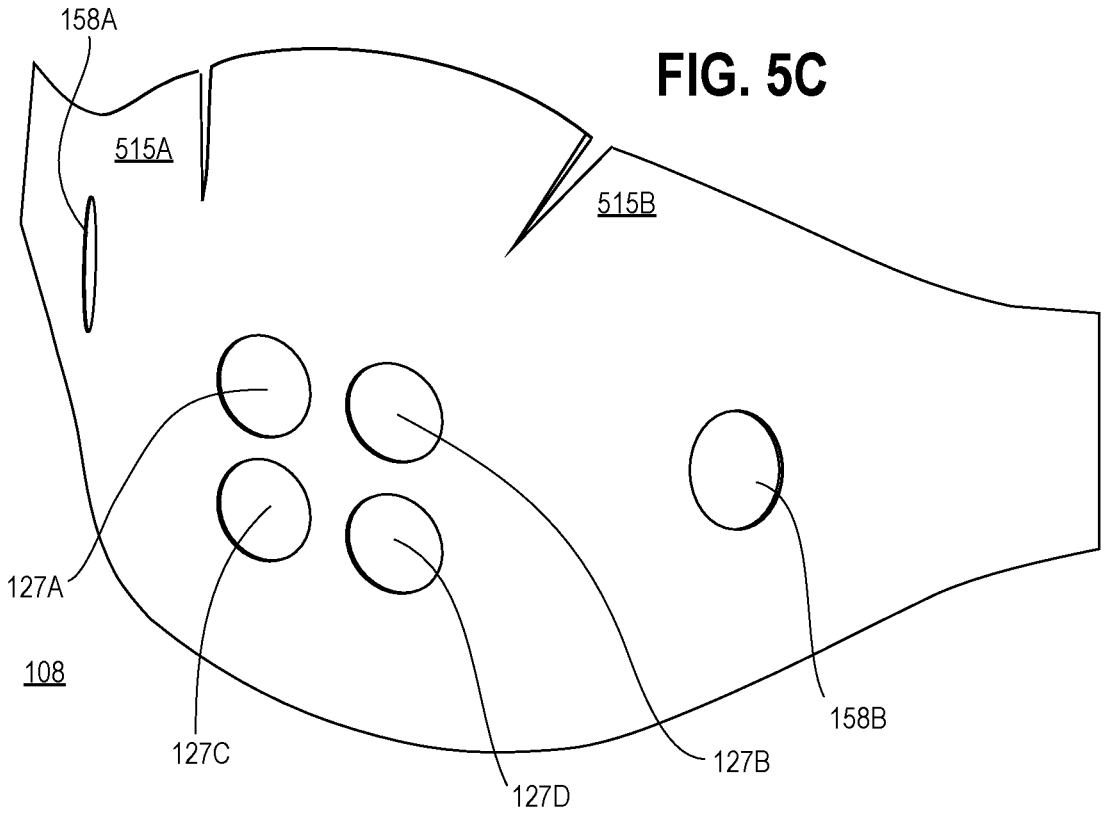

In FIG. 5C, the pair of slits 510A-510B are bent towards each other, bending the cardboard mask base 108 so as to create a three-dimensional mask base 108, bringing together a mask base top left section 515A and a mask base top right section 515B. The mask base 108 again further comprises the base intake holes 127A-127D and the base exhaust holes 158A-158B.

Figure 5D:
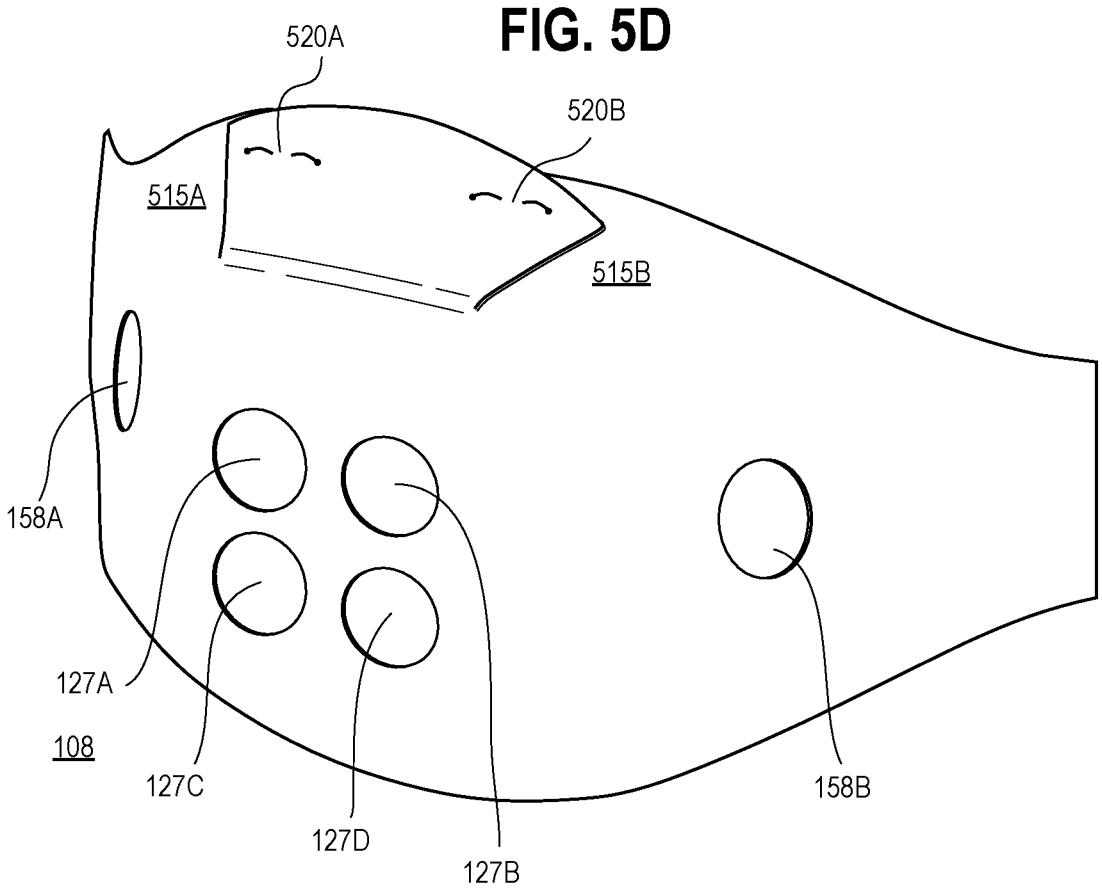
Figure 5E:
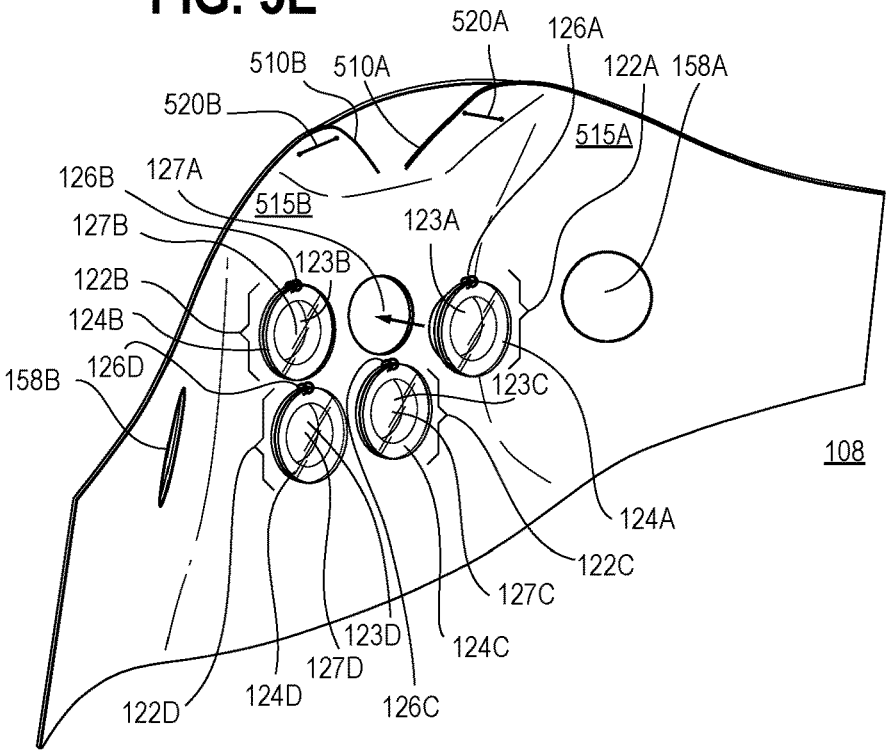

In FIG. 5D, a three-dimensional cardboard mask base 108 is created by further bending the slits 510A-510B towards each other, finishing the process of bringing together the mask base top left section 515A and the mask base top right section 515B. The mask base top left section 515A is fastened to the mask base top right section 515B. For example, the mask base top left section 515A and the mask base top right section 515B are stapled together using a first base staple 520A and a second base staple 520B. The three-dimensional cardboard mask base 108 takes on a cup-like shape configured generally to match contours of a user's face (not shown). The mask base 108 again further comprises the base intake holes 127A-127D and the base exhaust holes 158A-158B.

In FIG. 5E, the base 108 again further comprises the intake valve assemblies 122A-122D. The intake valve assemblies 122A-122D again comprise the intake valves 123A-123D, which again are attached to the corresponding intake valve bases 124A-124D by corresponding intake valve hinges 126A-126D. The intake valve assemblies 122A-122D again are installed in the respective base intake holes 127A-127D. The base 108 again further comprises the base exhaust holes 158A-158B, the slits 510A-510B, the mask base top sections 515A-515B, and the base staples 520A-520B.

Figure 5F:
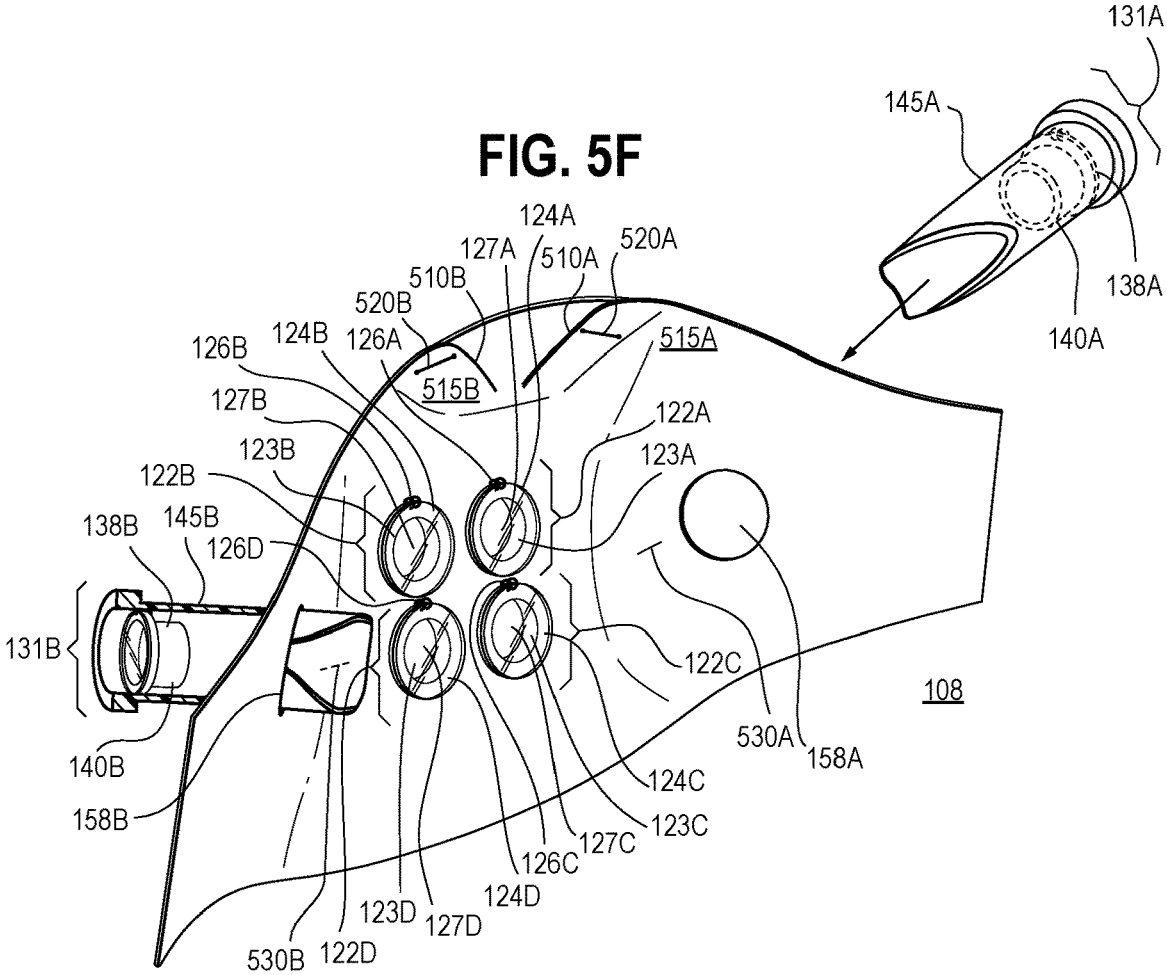

In FIG. 5F, the base 108 further comprises the exhaust valve assemblies 131A-131B. The exhaust valve assemblies 131A-131B again comprise the exhaust valves 138A-138B, which again are attached to the corresponding exhaust valve bases 140A-140B by the corresponding exhaust valve hinges 142A-142B. The exhaust valve assemblies 131A-131B again further comprise the respective exhaust tubes 145A-145B. The respective exhaust tubes 145A-145B again comprise the respective exhaust valves 140A-140B. The left exhaust tube 145A is depicted being installed in the left base exhaust hole 158A and fastened in place using a left exhaust staple 530A. The intake valve assemblies 122A-122D again comprise the intake valves 123A-123D, which again are attached to the corresponding intake valve bases 124A-124D by the corresponding intake valve hinges 126A-126D. The intake valve assemblies 122A-122D again are installed in the respective base intake holes 127A-127D. The base 108 again further comprises the base exhaust holes 158A-158B (the left base exhaust hole 158A is mentioned above), the base slits 510A-510B, the mask base top sections 515A-515B, and the base staples 520A-520B.

Figure 5G:
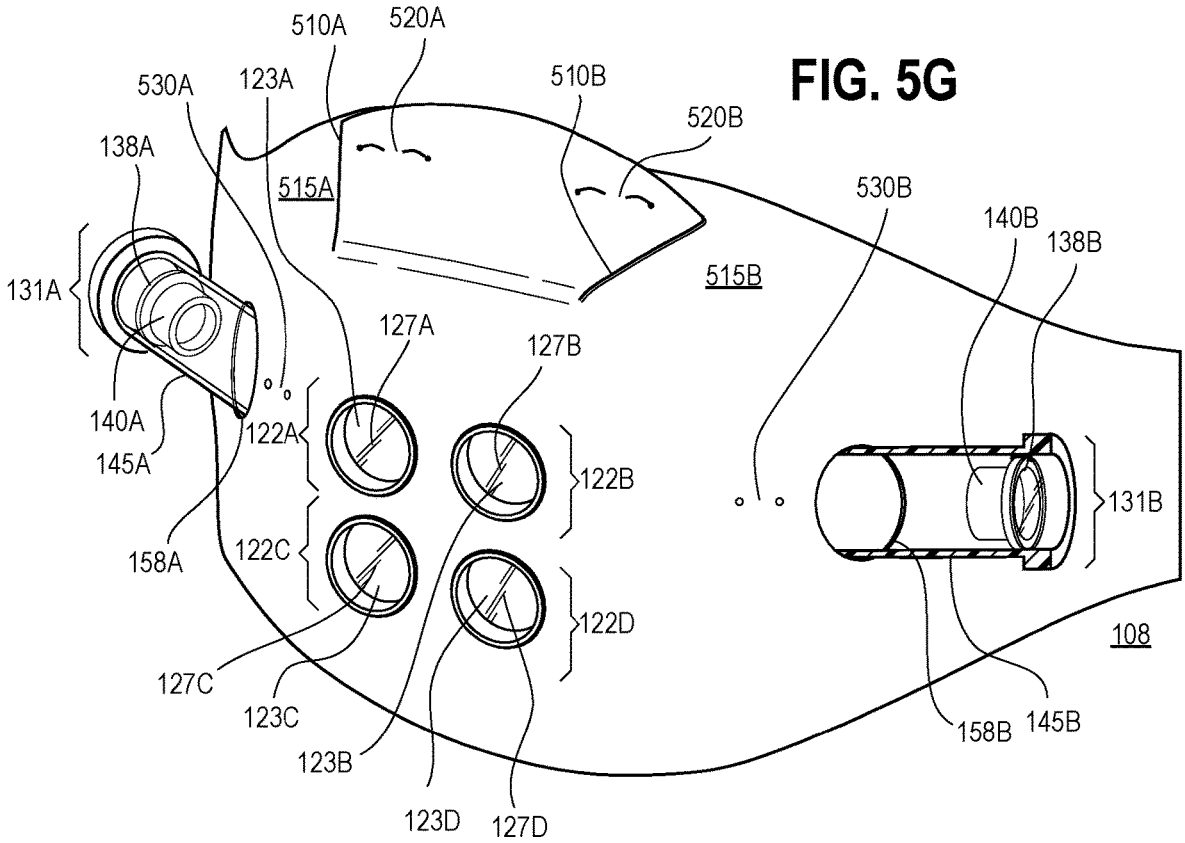

In FIG. 5G, an exterior view of the completed mask base 108 is shown. The mask base 108 again comprises the intake valve assemblies 122A-122D, the intake valves 123A-123D, the intake valve bases 124A-124D (these numbers are missing on the drawings), the intake valve hinges 126A-126D, the base intake holes 127A-127D, the exhaust valve assemblies 131A-131B, the exhaust valves 138A-138B, the exhaust valve bases 140A-140B, the exhaust tubes 145A-145B, the base exhaust holes 158A-158B, the base slits 510A-510B, the mask base top sections 515A-515B, the base staples 520A-520B, the left exhaust staple 530A, and a right exhaust staple 530B.

Figure 5H:
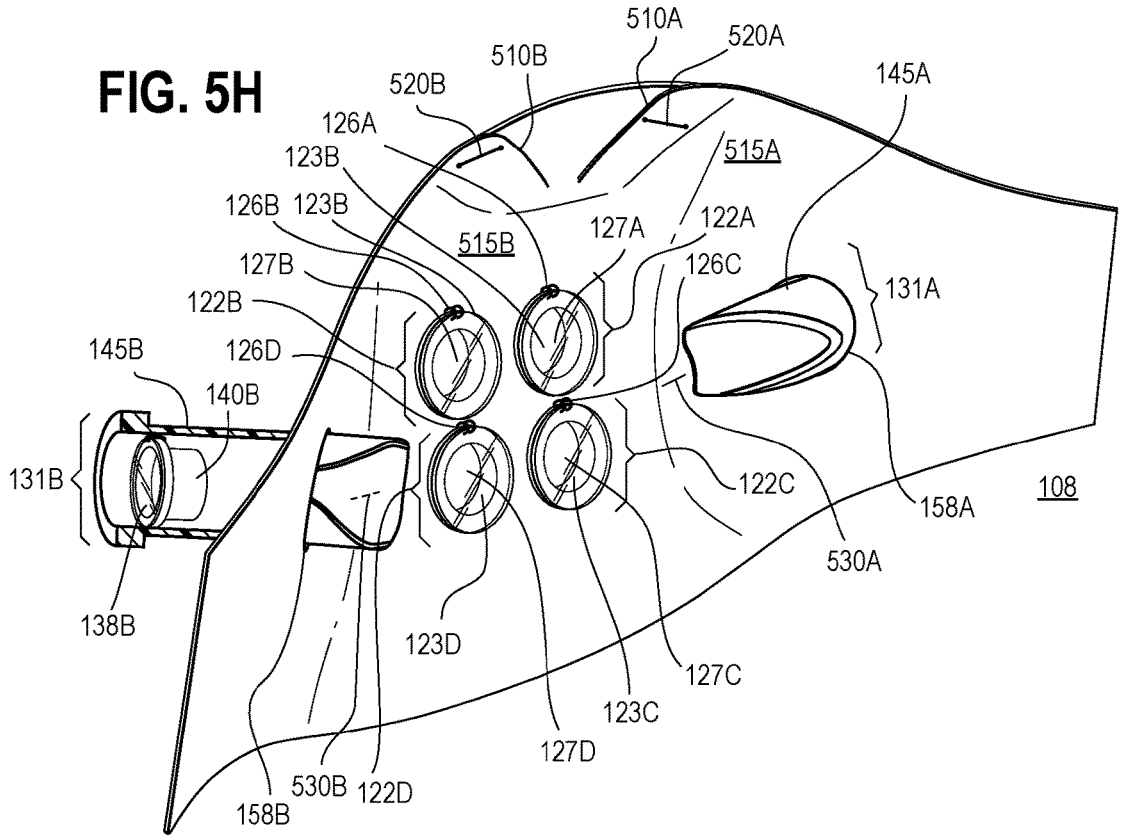

In FIG. 5H, an interior view of the completed mask base 108 is shown. The mask base 108 again comprises the intake valve assemblies 122A-122D, the intake valves 123A-123D, the intake valve bases 124A-124D (these numbers are missing on the drawings), the intake valve hinges 126A-126D, the base intake holes 127A-127D, the exhaust valve assemblies 131A-131B, the left exhaust valves 138A, the left exhaust valve base 140A, the exhaust tubes 145A-145B, the base exhaust holes 158A-158B, the base slits 510A-510B, the mask base top sections 515A-515B, the base staples 520A-520B, the left exhaust staple 530A, and the right exhaust staple 530B.

An additional advantage of embodiments of the invention is that the mask enables a user to avoid breathing his own exhaust. A further advantage of embodiments of the invention is that the exhaust valves are positioned a relatively long distance from the intake valve panel comprising the intake valves, so as to prevent the user from inadvertently breathing on the intake breath a substantial amount of air that has been exhaled on a prior exhale breath. Another advantage offered by embodiments of the invention is that the user will be breathing fresh air on each breath. A still further advantage of embodiments of the invention is enabling the user to avoid steaming up the user's eyeglasses. A still other advantage provided by embodiments of the invention is that construction of the mask, including but not limited to the soft foam lining and separation of the exhaust valves from the intake valves, does one or more of preventing unfiltered air from entering the mask and sealing the mask tightly. An additional advantage of embodiments of the invention is that the construction of the mask, including but not limited to the soft foam lining and separation of the exhaust valves from the intake valves, ensured that a user will breathe only filtered air.

An advantage of embodiments of the invention is that the invention protects one or more of the user and others from one or more of COVID-19 and another disease by filtering the user's intake breath to do one or more of provide protection from respiratory disease pathogens and remove respiratory disease pathogens. A still other advantage of embodiments of the invention is the square intake filter located in the approximate center of the mask that prevents one or more of the user and others from being infected by COVID-19.

Another advantage of embodiments of the invention is that the mask base enables adjustment of the mask according to contours of a particular user's face. A further advantage of embodiments of the invention is that the mask base can be form fit to match contours of the user's face. For example, a size of the base can vary depending on whether the user is a child or an adult and depending on a size of the user's face. A further advantage of embodiments of the invention is that the one or more of the soft foam lining and the hard foam lining can be contoured to match contours of a user's face, providing an ideal, tight fit.

Moreover, another advantage of embodiments of the invention is that the soft foam lining is configured to tightly hold the mask against the user's face, creating an ideal, snug, comfortable fit. A yet further advantage of embodiments of the invention is that the snug, comfortable fit against the user's face permits substantially no fogging of a user's eyeglasses. Another advantage of embodiments of the invention is that a size of the one or more of the soft foam lining and the hard foam lining can be varied according to a size of the intake valves. A still other advantage of embodiments of the invention is the flexibility in sizing of the mask base, the soft foam lining, the hard foam lining, and the mask facilitates identifying embodiments of the invention having an ideal size for any particular user. A yet further advantage of embodiments of the invention is that the one or more of the soft foam lining and the hard foam lining provides comfort of fit for the user, particularly in environments that are one or more of hot and humid.

A further advantage of embodiments of the invention is that disposable models of the invention comprise a cardboard mask base. A yet other advantage of embodiments of the invention is that models of the invention usable to participate in sports comprise a more durable, and more hypoallergenic, heavy duty plastic mask base.

A yet other advantage of embodiments of the invention is that one or more of the base, the soft foam lining and the hard foam lining, all of which are hypoallergenic in preferred embodiments, helps protect the user from contact dermatitis, including contact dermatitis with extended wear of the mask. A still further advantage of embodiments of the invention is that one or more of the soft foam lining and the hard foam lining promote comfort of fit for the user, particularly in environments that are one or more of hot and humid. An additional advantage of embodiments of the invention is that the layered design comprising one or more of the hard foam lining and the soft foam lining, and preferably comprising both the hard foam lining and the soft foam lining permits lips of a user to not contact an interior surface of the mask.

A further advantage of embodiments of the invention is that one or more of the mask base and the intake valve panel substantially eliminate inward leakage of particles into a breathing zone across an interface of the device and a face of the user. A yet other advantage of embodiments of the invention is that one or more of the mask base and the intake valve panel promote optimum filtration efficiency. Another advantage of embodiments of the invention is that one or more of the mask base and the intake valve panel minimize inhalation airflow resistance.

A further advantage of embodiments of the invention is avoiding use of flimsy diaphragms as is common in the prior art.

A still other advantage of embodiments of the invention is that the use of check valves comprising a return spring allows users to recline while using the mask and breathing.

A still further advantage of embodiments of the invention is that the exhaust filter avoids spreading diseases. A yet other advantage of embodiments of the invention is that air can exit the filter without being slowed down. Another advantage of embodiments of the invention is that a user can read for an extended period of time such as, for example, approximately 45 minutes, with the mask in place without the user's eyeglasses steaming up.

An additional advantage of embodiments of the invention is a sturdier construction compared to the prior art. A still further advantage of embodiments of the invention is that the mask, partly because it comprises a sliding intake filter, has the ability to be used in conjunction with medical devices such as oxygen tanks. Another advantage of embodiments of the invention is a user can continue to wear oxygen tubing that slides into the front of the mask, while wearing the mask.

A further advantage of embodiments of the invention is that the mask comprises the intake valve panel positioned at the approximate mask center and the left and right exhaust valves respectively positioned on the left and right sides of the mask, so that the mask ensures that the user is not breathing the user's own exhaust. An additional advantage of embodiments of the invention is that the mask has high separation of the intake valves from the exhaust valves, ensuring that the user has substantially no carbon dioxide intake. A yet other advantage of embodiments of the invention, partially due to this same feature of separation of the intake valves from the exhaust valves, the user can use the mask without fogging the user's eyeglasses.

Another advantage of embodiments of the invention is that the mask can be sterilized on a daily basis, allowing a user to wake up with a fresh and sterile filtration system ready to go.

A still other advantage of embodiments of the invention is that the exhaust tubes comprise one or more of transparent material and translucent material, allowing ultraviolet light to sanitize all parts of the mask.

A still further advantage of embodiments of the invention is that the mask is usable by one or more of painters, cleaners, and construction workers seeking to avoid one or more of dust from construction sites and toxic fiberglass dust.

While the above representative embodiments have been described with certain components in exemplary configurations, it will be understood by one of ordinary skill in the art that other representative embodiments can be implemented using different configurations and/or different components. For example, it will be understood by one of ordinary skill in the art that the order of certain steps and certain components can be altered without substantially impairing the functioning of the invention. It will be further understood by those of skill in the art that the number of variations of embodiments of the invention are virtually limitless.

For example, a bandanna can fulfill functions of one or more of the intake filter and the exhaust filters. For example, the bandanna can fulfill functions of both the intake filter and the exhaust filters. For example, the mask comprises a microphone located on the inside of the mask for ease of communication by a masked user. For example, the mask protects one or more of the user and others from one or more of a disease, a virus, a flu, and an illness other than COVID-19.

For example, other embodiments of the invention comprise one or more of disposable embodiments and embodiments designed for one or more of children, adults, athletes, physicians, other medical workers, and users with facial hair. Additional embodiments of the invention are designed for use by users participating in sports. For example, disposable models of embodiments of the invention are also provided that are usable for approximately one day to three weeks. For example, the disposable embodiments comprise a left strap that is smaller than the left strap used according to non-disposable embodiments of the invention. For example, the disposable embodiments comprise a right strap that is smaller than the right strap used according to non-disposable embodiments of the invention. For example, the disposable embodiments comprise a left strap that does not comprise Velcro. For example, the disposable embodiments comprise a right strap that does not comprise Velcro.

For example, disposable embodiments may comprise the intake filter without comprising the intake valves. These embodiments will also omit the intake valve panel.

For example, embodiments of the invention designed for children may be sized smaller than the principal embodiment of the invention. For example, the embodiments of the invention designed for children comprise two intake valves rather than four intake valves as per the disclosed principal embodiment of the invention.

For example, embodiments of the invention designed for one or more of doctors and other medical workers comprise one or more of a disposable intake filters and a disposable exhaust filter.

For example, embodiments of the invention designed for athletes comprise more than four intake valves. For example, embodiments of the invention designed for athletes comprise six intake valves. For example, the embodiments of the invention designed for athletes comprise an intake valve panel comprising the six intake valves. For example, embodiments of the invention designed for athletes comprise eight intake valves. For example, the embodiments of the invention designed for athletes comprise an intake valve panel comprising the eight intake valves. For example, the embodiments of the invention designed for athletes comprise intake valves having a larger diameter. For example, embodiments of the invention designed for athletes comprise more than two exhaust valves. For example, the embodiments of the invention designed for athletes comprise exhaust valves having a larger diameter. For example, the embodiments of the invention designed for athletes comprise two exhaust valves on each of the two sides of the mask. Further embodiments of the invention comprise one exhaust valve. Other embodiments of the invention omit the exhaust filter. Still further embodiments of the invention omit the intake filter. Still other embodiments of the invention omit the intake valves.

A yet further advantage of embodiments of the invention is low cost. An additional advantage of embodiments of the invention is mass producibility. Another advantage of embodiments of the invention is particularly low cost for disposable embodiments. A still other advantage of embodiments of the invention is ease of manufacture. A still further advantage of embodiments of the invention is cost efficiency.

The representative embodiments and disclosed subject matter, which have been described in detail herein, have been presented by way of example and illustration and not by way of limitation. It will be understood by those skilled in the art that various changes may be made in the form and details of the described embodiments resulting in equivalent embodiments that remain within the scope of the invention. It is intended, therefore, that the subject matter in the above description shall be interpreted as illustrative and shall not be interpreted in a limiting sense.

What is claimed is:

1. A dual filtration COVID-19 mask comprising:

an intake valve panel comprising one or more intake valves, the intake valve panel positioned in an approximate center of the mask, the one or more intake valves configured to open to transmit a user's intake breath, the one or more intake valves further configured to close after transmission of the user's intake breath and prior to the user's next exhale breath, the intake valve panel further comprising an intake filter configured to filter the user's intake breath;

one or more exhaust valves, the one or more exhaust valves positioned to a side of the mask, the one or more exhaust valves configured to open to transmit the user's exhale breath, the one or more exhaust valves further configured to close after transmission of the user's exhale breath and prior to the user's next intake breath;

one or more exhaust tubes, at least one of the one or more exhaust tubes comprising at least one of the one or more exhaust valves, the at least one exhaust tube configured to conduct the user's exhale breath through the at least one exhaust valve and then out of the mask, the at least one exhaust tube holding the at least one exhaust valve tightly while allowing the at least one exhaust valve to open and close freely;

a soft foam lining configured to tightly hold the mask against the user's face; and a hard foam lining attached to the mask, the hard foam lining attached to the soft foam lining, the hard foam lining configured to hold the intake valve panel at a distance from the user's face, thereby allowing the one or more intake valves to open and close freely.

2. The COVID-19 mask of claim 1, further comprising:

a base configured firmly to hold the intake valve panel and the at least one exhaust tubes.

3. The COVID-19 mask of claim 2, wherein the at least one exhaust tube passes through the base to an outside of the mask, so as to conduct the user's exhale breath out through the at least one exhaust tube.

4. The COVID-19 mask of claim 3, wherein the at least one exhaust tube further comprises an exhaust filter configured to filter the user's exhale breath.

5. The COVID-19 mask of claim 4, wherein the exhaust filter attaches to an exhaust end of the at least one exhaust tube.

6. The COVID-19 mask of claim 5, wherein the at least one exhaust valve comprises an exhaust valve diameter slightly less than an exhaust tube diameter of the at least one exhaust tube.

7. The COVID-19 mask of claim 6, wherein the at least one exhaust valve is located approximately three-eighths of an inch from the exhaust end of the at least one exhaust tube.

8. The COVID-19 mask of claim 1, wherein the intake valve panel comprises exactly four intake valves.

9. The COVID-19 mask of claim 1, wherein at least one of the one or more intake valves comprises a check valve.

10. The COVID-19 mask of claim 9, wherein each of the one or more intake valves comprises a check valve.

11. The COVID-19 mask of claim 1, wherein at least one of the one or more exhaust valves comprises a check valve.

12. The COVID-19 mask of claim 1, wherein each of the one or more exhaust valves comprises a check valve.

13. The COVID-19 mask of claim 1, wherein the intake filter is positioned adjacent to and outside of the intake valve panel.

14. The COVID-19 mask of claim 13, further comprising an intake filter slot configured to receive the intake filter, the intake filter slot further configured to hold the intake filter firmly in place.

15. The COVID-19 mask of claim 2, wherein the hard foam lining is attached to the base on an opposite side of the hard foam lining from the soft foam lining.

16. The COVID-19 mask of claim 2, the base further comprising at least one anchor configured to attach the mask base to a mask cover.

17. A COVID-19 mask comprising:

an intake valve panel comprising exactly four valves, the intake valve panel positioned in an approximate center of the mask, each of the intake valves configured to open to transmit a user's intake breath, each of the intake valves further configured to close after transmission of the user's intake breath and prior to the user's next exhale breath, the intake valve panel further comprising an intake filter configured to filter the user's intake breath;

one or more exhaust valves configured to open to transmit the user's exhale breath, the one or more exhaust valves positioned to a side of the mask, each of the one or more exhaust valves further configured to close after transmission of the user's exhale breath and prior to the user's next intake breath;

one or more exhaust tubes, at least one of the one or more exhaust tubes comprising at least one of the one or more exhaust valves, the at least one exhaust tube configured to conduct the user's exhale breath through the at least one exhaust valve and then out of the mask, the at least one exhaust tube holding the at least one exhaust valve tightly while allowing the at least one exhaust valve to open and close freely;

a soft foam lining configured to tightly hold the mask against the user's face;

a base configured firmly to hold the intake valve panel and the at least one exhaust tube, wherein the at least one exhaust tube passes through the base to an outside of the mask, so as to conduct the user's exhale breath out through the at least one exhaust tube, wherein the at least one exhaust tube further comprises an exhaust filter configured to filter the user's exhale breath, wherein the exhaust filter attaches to a same end of the at least one exhaust tube as the at least one exhaust valve, wherein the at least one exhaust valve comprises an exhaust valve diameter slightly smaller than an exhaust tube diameter of the at least one exhaust tube; and a hard foam lining attached to the soft foam lining, the hard foam lining attached to the base on an opposite side of the hard foam lining from the soft foam lining, the hard foam lining configured to hold the intake valve panel at a distance from the user's face, thereby allowing the intake valves to open and close freely.

18. A COVID-19 mask configured to allow a user to breathe, comprising:

an intake valve panel comprising exactly four intake valves, the intake valve panel positioned in an approximate center of the mask, each of the intake valves comprising a check valve, each of the intake valves configured to open to transmit a user's intake breath, each of the intake valves further configured to close after transmission of the user's intake breath and prior to the user's next exhale breath;

an intake filter configured to filter the user's intake breath, the intake filter attached to the intake valve panel, the intake filter positioned adjacent to and outside of the intake valve panel;

one or more exhaust valves configured to open to transmit the user's exhale breath, the one or more exhaust valves positioned to a side of the mask, each of the one or more exhaust valves comprising a check valves, each of the one or more exhaust valves further configured to close after transmission of the user's exhale breath and prior to the user's next intake breath, wherein each of the one or more exhaust valves is located approximately three-eighths of an inch from an end of an exhaust tube;

one or more exhaust tubes, at least one of the one or more exhaust tubes comprising at least one of the one or more exhaust valves, the at least one exhaust tube configured to conduct the user's exhale breath through the at least one exhaust valve and then out of the mask, the at least one exhaust tube holding the at least one exhaust valve tightly while allowing the at least one exhaust valve to open and close freely;

a soft foam lining configured to tightly hold the mask against the user's face;

a base configured firmly to hold the intake valve panel and the at least one exhaust tube, wherein the at least one exhaust tube passes through the base to an outside of the mask, so as to conduct the user's exhale breath out through the at least one exhaust tube, wherein the at least one exhaust tube further comprises an exhaust filter configured to filter the user's exhale breath, wherein the exhaust filter attaches to a same end of the at least one exhaust tube as the at least one exhaust valve, wherein the at least one exhaust valve comprises an exhaust valve diameter slightly smaller than an exhaust tube diameter of the at least one exhaust tube, the base further comprising at least one anchor configured to attach the mask base to a mask cover;

an intake filter slot configured to receive the intake filter, the intake filter slot further configured to hold the intake filter firmly in place; and a hard foam lining attached to the base on an opposite side of the hard foam lining from the soft foam lining, the hard foam lining configured to hold the intake valve panel at a distance from the user's face.

* * * * *